US005895282A

United States Patent [19]

Little

[11] Patent Number: 5,895,282

[45] Date of Patent: Apr. 20, 1999

[54] CONNECTOR FOR AIRBAG GAS GENERATOR

[75] Inventor: Philip V. Little, High Wycombe, United Kingdom

[73] Assignee: Thomas & Betts Corporation, Memphis, Tenn.

[21] Appl. No.: 08/858,720

[22] Filed: May 19, 1997

Related U.S. Application Data

[60] Provisional application No. 60/018,290, May 24, 1996.

[51] Int. Cl.[6] ..... H01R 4/50

[52] U.S. Cl. ..... 439/332; 439/372

[58] Field of Search ..... 439/332, 314, 439/316, 372

[56] References Cited

U.S. PATENT DOCUMENTS

| | | |
|---|---|---|
| 3,869,191 | 3/1975 | Tolnar, Jr. et al. . |
| 4,380,346 | 4/1983 | Davis et al. . |
| 4,850,888 | 7/1989 | Denlinger et al. . |
| 5,203,719 | 4/1993 | Kozono . |
| 5,297,976 | 3/1994 | VanDerStuyf et al. . |
| 5,334,025 | 8/1994 | Föhl . |
| 5,401,180 | 3/1995 | Muzslay . |
| 5,458,371 | 10/1995 | Fulmer et al. . |
| 5,494,450 | 2/1996 | Kirsch et al. . |
| 5,498,164 | 3/1996 | Ward et al. . |
| 5,528,161 | 6/1996 | Liken et al. . |
| 5,616,045 | 4/1997 | Gauker . |

*Primary Examiner*—Khiem Nguyen
*Assistant Examiner*—Eugene G. Byrd
*Attorney, Agent, or Firm*—Hoffmann & Baron, LLP

[57] ABSTRACT

A connector assembly having a male plug connector and a female socket connector. The male plug connector includes an elongate housing and a dependent housing shaft. An elongate first electrical contact is supported in the housing and has a first cable terminating end and an opposed interconnection end extending into said shaft. A latch is rotatably supported by the housing about the shaft. The socket connector includes a female connector housing having a central cavity therein for insertable connection with the housing shaft. A second electrical contact is supported in the cavity of the female connector housing for electrical engagement with the interconnection end of the first contact upon insertable engagement between the housing shaft of and the female connector housing. A mating latch receiving element is formed on the female connector housing for matingly receiving said latch of the male connector so that the latch is rotatably movable into locking engagement with said the receiving element under the bias of a spring upon insertable engagement between the shaft and the female connector housing.

20 Claims, 22 Drawing Sheets

FIG. 13B
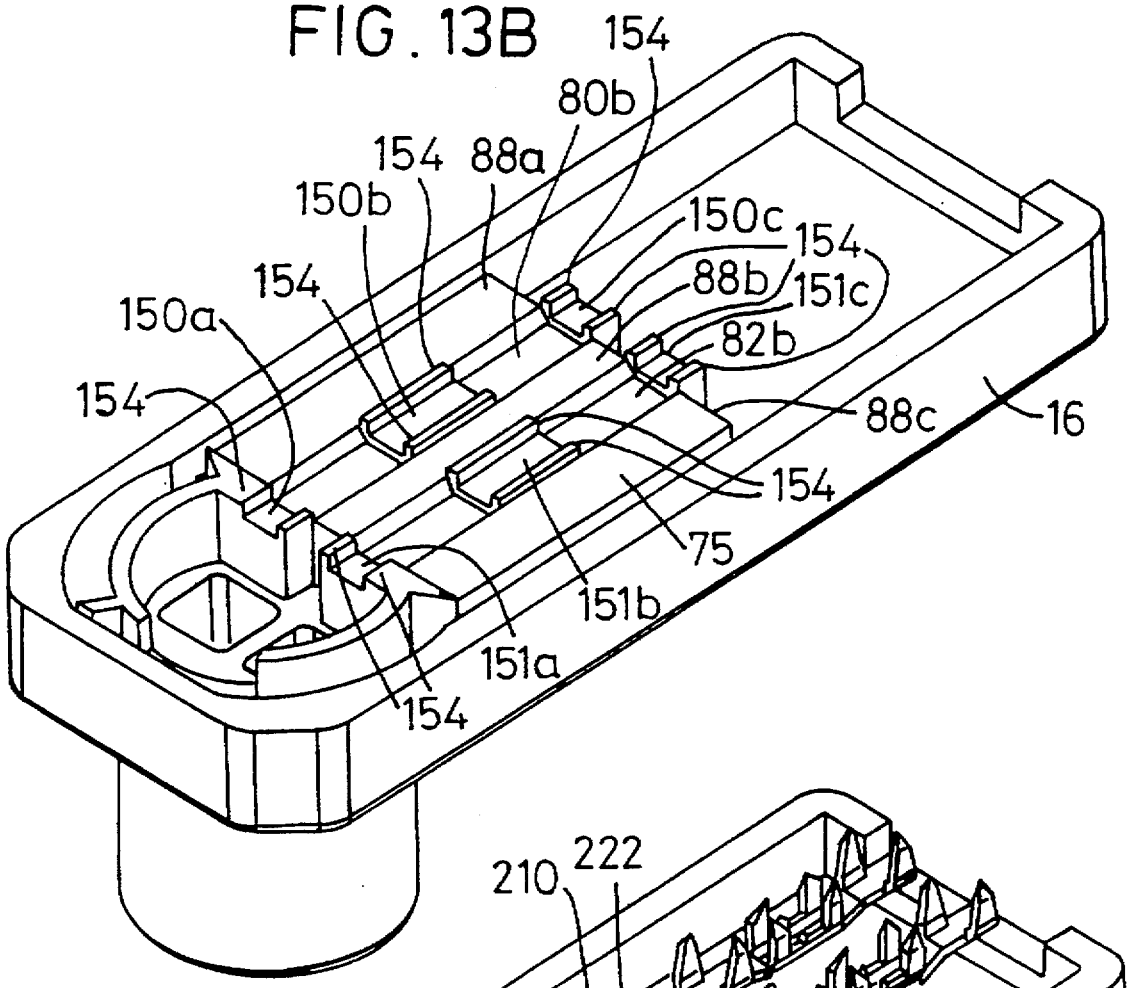
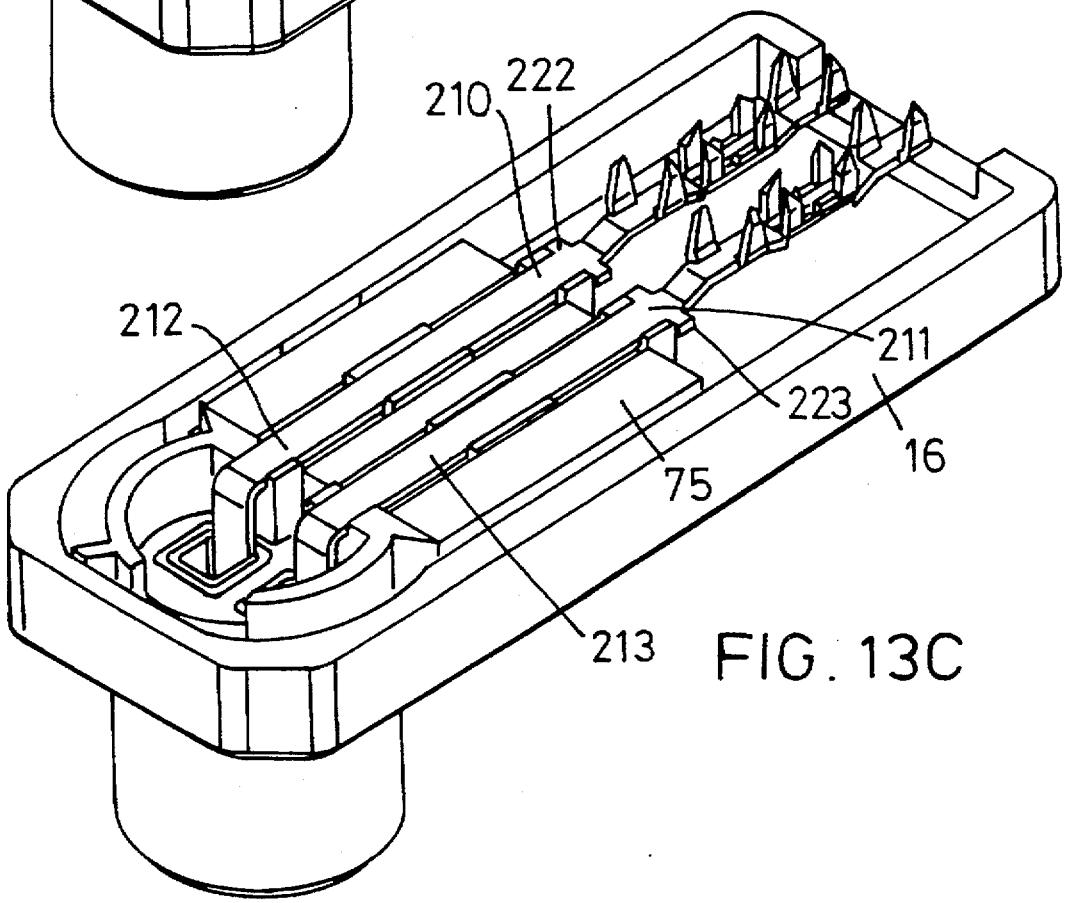
FIG. 13C

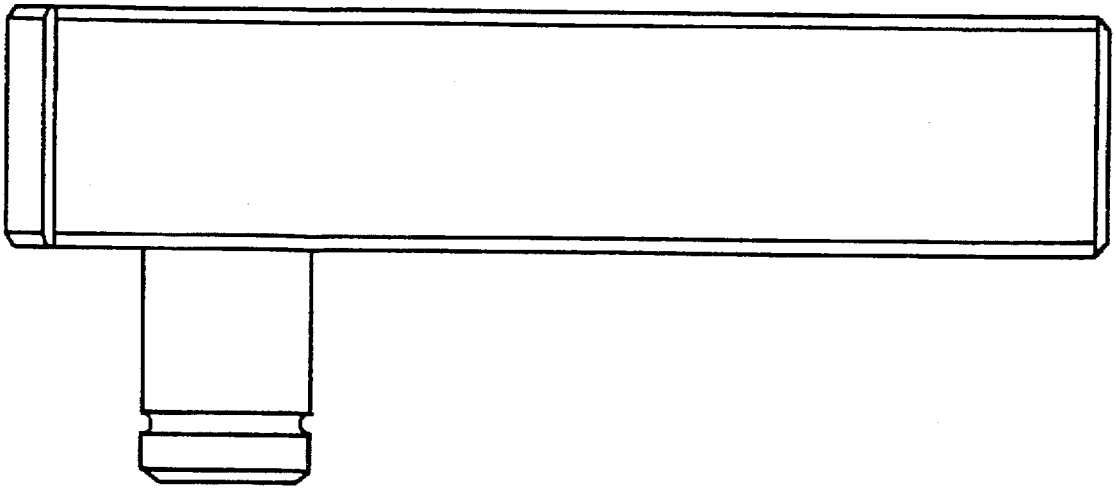
FIG. 16
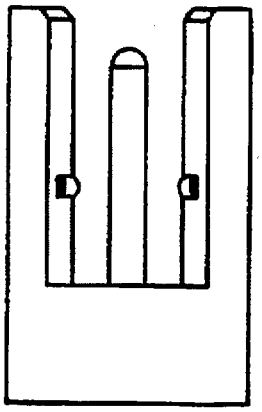

CONNECTOR FOR AIRBAG GAS GENERATOR

This application claims the benefit of U.S. Provisional Appln. No. 60/018,290 filed May 24, 1996.

FIELD OF THE INVENTION

The present invention relates to an electrical connection assembly. More specifically, the present invention relates to a connector for an airbag gas generator assembly.

BACKGROUND OF THE INVENTION

Airbag gas generators cause automobile airbags to inflate during sufficiently extreme impact environments. A gas generator is an electro-explosive device (EED), or squib, initiated by an electrical signal generated by a control device that senses impact forces and determines if the forces fall within the parameters indicating the need for airbag inflation. Once the squib has received a firing signal from the control device, the explosive gases produced by the squib inflate the airbag quickly. The control system is connected to the airbag by means of a wiring harness which typically includes an electrical plug and socket connector arrangement to permit an easy method of electrically joining the airbag assembly and the control system after they have been separately installed. As the airbag is a critical safety device that is relied upon to help protect occupants of a vehicle in an accident, its proper operation is of paramount importance.

Proper operation of the system requires that the signal for firing the airbag be transmitted to the airbag gas generator. Towards this end, connectors for airbag gas generators have been developed with a goal of providing a secure and reliable connection for relaying a fire signal to the airbag gas generator during an accident. A typical design for a connector in this field as known in the prior art is depicted in FIG. 16 which shows a connector that is retained in the mated position by means of a groove around a male part engaging a rib in the female socket. A drawback of this connection assembly is that it requires the assembly operator to fully push the locking piece into place but gives no indication that full engagement has occurred. It is possible for the operator to fail to fully insert the connector while giving the operator an appearance of locking engagement between the components.

Manufacturers are now seeking to improve the retention of the connector by employing a means for positively retaining the connector within the catch. An example of a prior art connector employing a positive latching mechanism is shown in FIG. 17. The connector of FIG. 17 incorporates a separate locking piece having latching legs for insertion into the mated connector. The reliability of this configuration also suffers due to the possibility that an assembly operator may altogether forget to insert the locking piece into the mated connector or may likewise not fully insert the locking piece into a locking position.

There is therefore a need in the art for an electrical connection assembly for an airbag gas generator assembly that provides a positive latching mechanism with a two-piece connection assembly. The connection assembly should work automatically without requiring additional effort on the part of the assembly operator. Furthermore, it is desirable to provide an electrical connection assembly that tends to force the mating components apart until the fully mated position is reached. It is also desirable to provide an electrical connection assembly that requires a separate tool and two independent releasing forces to attain disconnection.

Additionally, it is desirable to provide an electrical connection assembly for an airbag gas generator assembly that utilizes a minimum number of parts to ensure reliable assembly of the connector assembly constituent elements.

SUMMARY OF THE INVENTION

It is an object of the present invention to provide a positive retention latch feature for an electrical connection assembly for an airbag gas generator assembly.

It is another object of the present invention to provide an electrical connection assembly employing a split ferrite shield.

It is still another object of the present invention to provide an electrical connection assembly for an airbag gas generator assembly having an automatic retention latch assembly that requires no additional actions by an assembly operator to positively connect.

It is a further object of the present invention to provide an electrical connection assembly for an airbag gas generator assembly that requires a single force to positively connect and requires multiple independent simultaneously applied forces to disconnect.

It is a further object of the present invention to provide an electrical connection assembly for an airbag gas generator assembly that forces the connecting components apart until the fully mated position is reached.

It is yet another object of the present invention to provide an electrical connection assembly for an airbag gas generator assembly having an automatic positive retention latch feature that requires the application of multiple independent release forces for disconnection.

In the efficient attainment of these and other objects the present invention provides an electrical connection assembly for an airbag gas generator. The connection assembly includes a connector having an independently rotatable latch, the prongs of which arcuately rotate about an elongate connector shaft that defines an expanse in which are supported a number of electrical contacts. Each prong is deflected under the bias of a spring projecting in like directions about the shaft from each prong. The free end of each prong also includes a hook projecting in like directions about the shaft opposite the longitudinal axis of the prong from the corresponding cantilever spring. Each hook includes a tapering undersurface contiguous with the free end of the prong and forming an acute angle with the longitudinal axis of the prong. Each tapering undersurface is contiguous with a hookface that runs substantially perpendicular to the longitudinal axis of the prong. The latch is spring-biased towards an undeflected position about the shaft. The socket connector includes a perimetrical wall defining a flag-shaped aperture for insertably receiving each prong of the latch. Each flag-shaped aperture includes a tab extending thereinto in flush alignment with the rim of the socket connector. The underside of each tab is a hookface in substantially uniform opposition to the hookface of the inserted latch.

When the connector shaft is inserted into the socket connector, each tapering undersurface engages the rim at the tab, and each cantilever spring engages the rim at the opposing extent of the gap. As the connector is forced into the socket connector in an axial direction, the force of the tab against the tapering undersurface causes the latch to deflect away from the tab. Continued insertion of the connector causes the tab to ride along the tapered undersurface. Meanwhile, the cantilever spring is deflected towards its latch prong and allows the latch prong to be inserted further into the gap in the socket connector. Once the latch hook is inserted clear of the tab, the cantilever spring is free to decompress and forces the latch to rotate in a locking direction opposite to the insertion deflection direction. Rotation of the latch in the locking direction positions the hookface of the latch opposite the hookface of the tab. The plug connector is thereby positively retained within the socket connector due to the interfering engagement between the hookfaces. The connectors cannot be disconnected by simply pulling the plug connector in a direction opposite to the insertion direction. First a tool is required to engage and rotate the latch in the deflection direction until latch hookface is no longer opposite the tab hookface and then the connector may be removed by pulling the connector in a direction opposite to the insertion direction.

One embodiment of the present invention also provides a split ferrite shield within the body of the connector. Each of the leads of the connector are contiguous with the contacts of the connector shaft through an elongate channel formed between the two ferrite halves.

An alternate embodiment of the present invention employs a conventional induction coil for shielding the connector.

The present invention achieves the above-stated objectives utilizing a minimum of parts to facilitate the assembly of the connector.

BRIEF DESCRIPTION OF THE DRAWINGS

FIG. 13B shows the other symmetrical half of the ferrite assembly of FIG. 6 inserted into the interior expanse of the housing of FIG. 7.

FIG. 13C shows the contacts of FIG. 10 inserted into the assembly of FIG. 13B.

FIG. 16 shows an electrical connection assembly of the prior art.

DETAILED DESCRIPTION OF THE PREFERRED EMBODIMENT

The present invention includes an electrical connector assembly 1 for providing connection between components of an airbag gas generator assembly. The connector assembly 1 comprises a male plug connector 10 and a female socket connector 12.

Figure 1A:
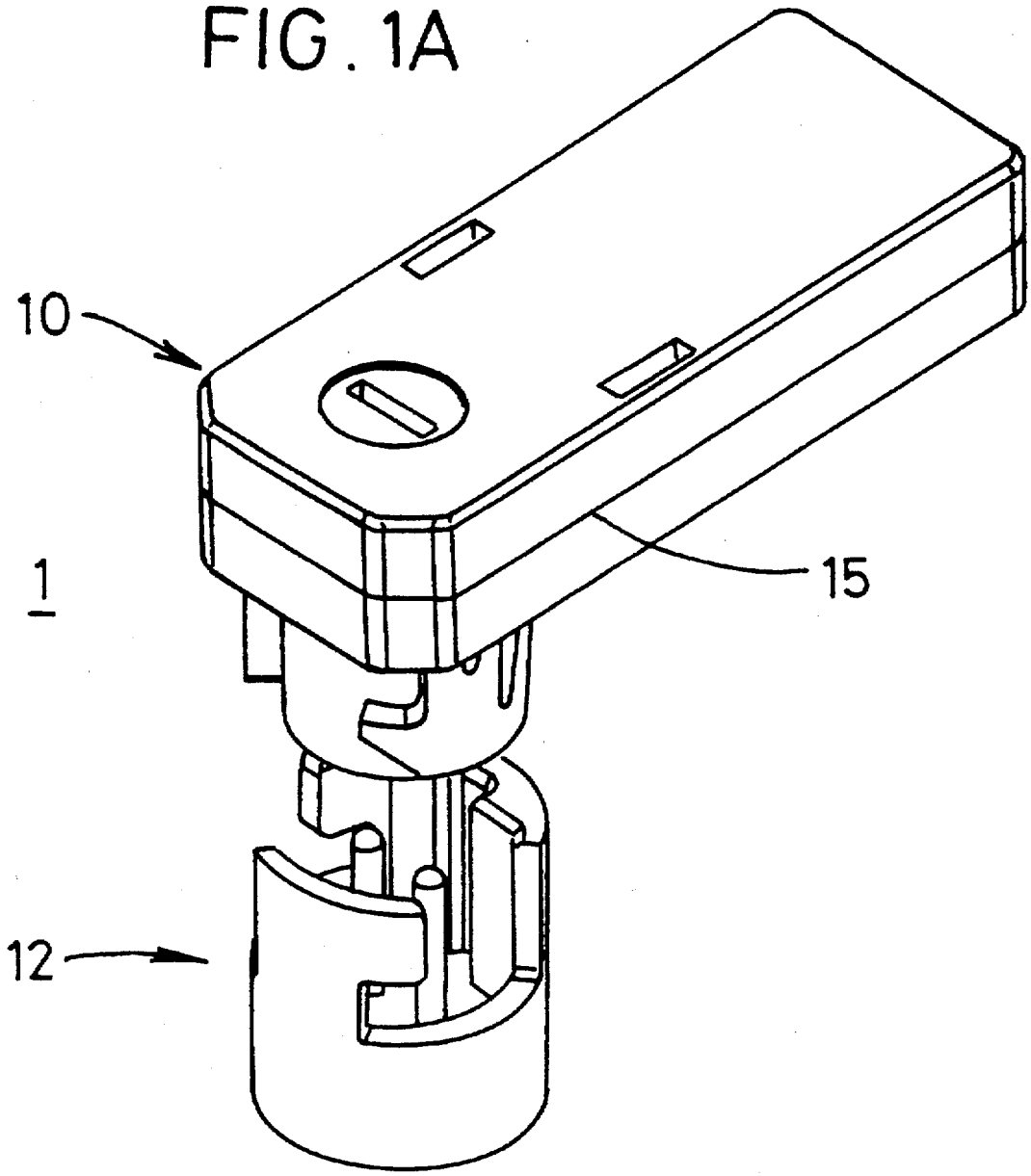
FIG. 1A shows the alignment of the plug connector and socket connector of the present invention.
Figure 1B:
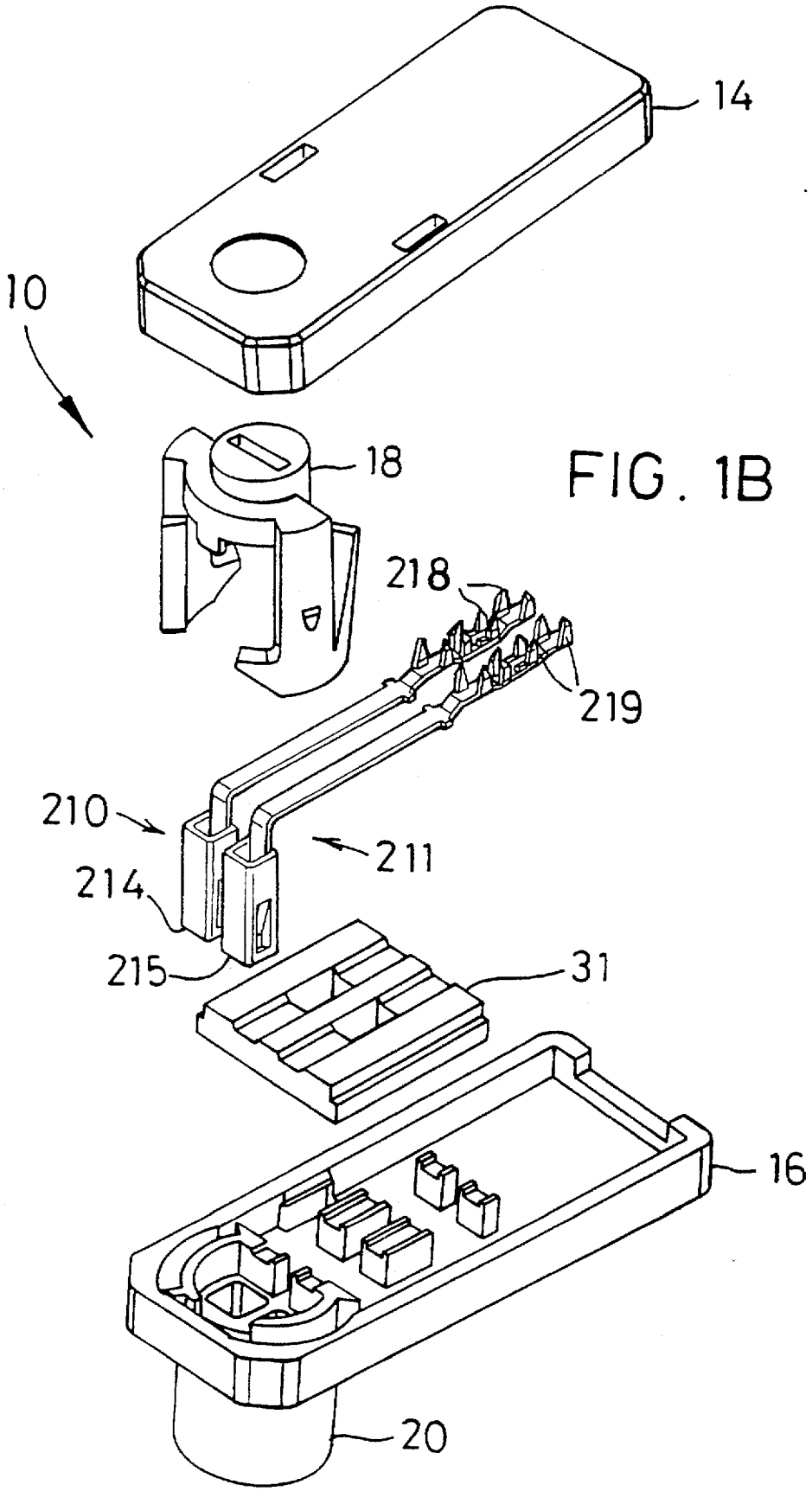
FIG. 1B shows an exploded view of the plug connector of the present invention.
Figure 1C:
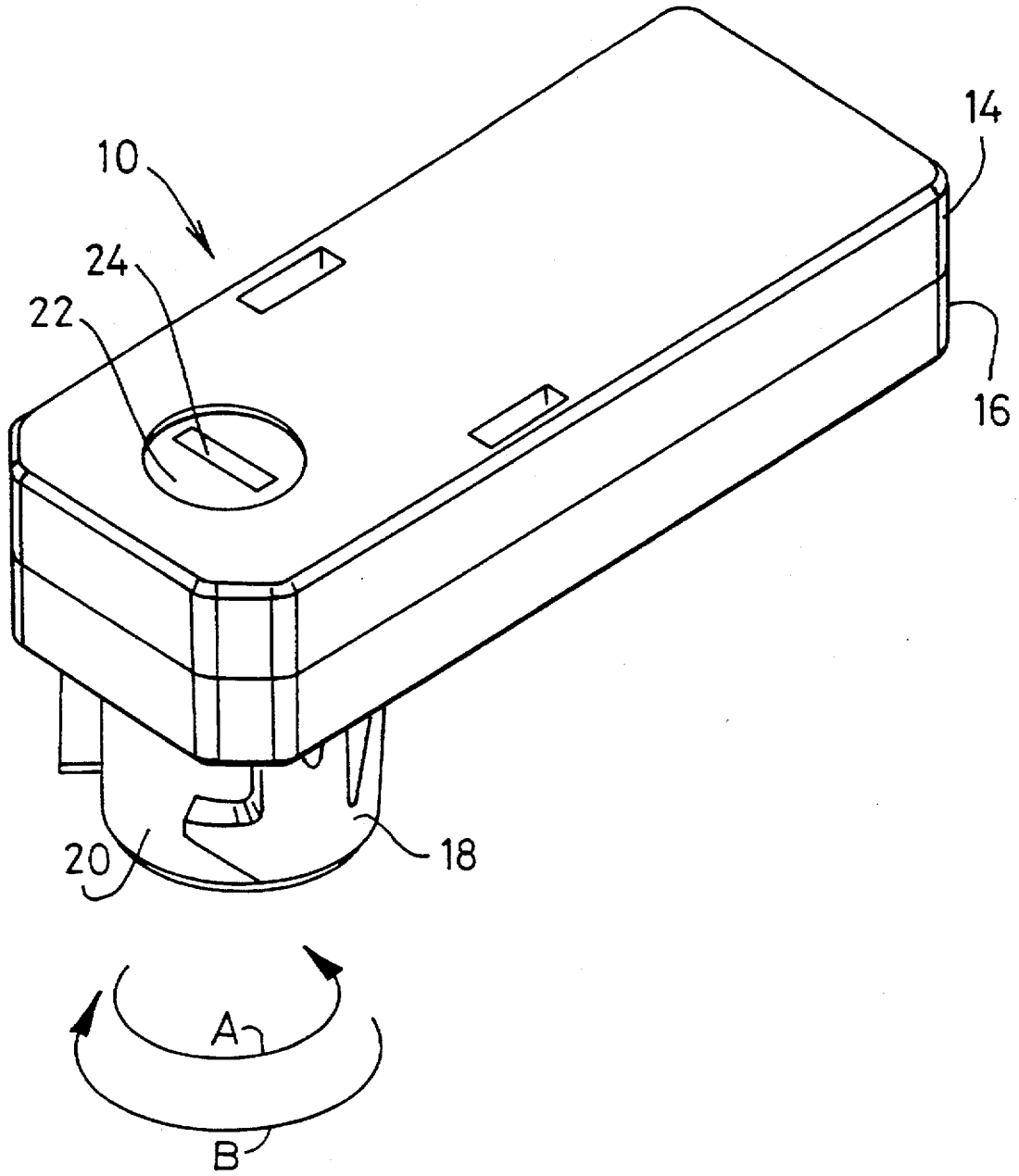
FIG. 1C shows the a isometric view of the plug connector of FIG. 1A, showing the relationship between the cover, base, and latch.

With reference to FIG. 1B, plug connector 10 includes an electrically insulative housing 15 having a base 16, a cover 14, and a latch 18 for providing positive retentive interconnection with socket connector 12 of FIG. 1A. Base 16 includes stationary shaft 20 extending from the underside thereof which has an outer surface that conforms to the interior surface of socket connector 12. Plug connector 10 supports electrical contacts 210, 211 therein. Electrical contacts 210, 211 are elongate right-angle contacts as are known in the art. Contacts 210, 211 include a cable terminating end 218, 219 providing a crimping wire connection for connecting to the conductors of a flat flexible cable leading to the airbag squib and an opposed interconnection end including a socket contact 214, 215 for accepting the contact pins 234, 235 of socket connector 12. Housing 15 includes ferrite assembly 72 (shown in full detail in FIG. 5) formed of two symmetrical ferrites 74, 75 for shielding the electrical contacts 210, 211 passing therebetween in electrical isolation. Latch 18 is movably supported in housing 15 with limited freedom to rotate about stationary housing shaft 20. Latch 18 includes a pair of prongs 160, 161 which protrude through the underside of base 16 and provide for locking retention with socket connector 12.

Figure 12:
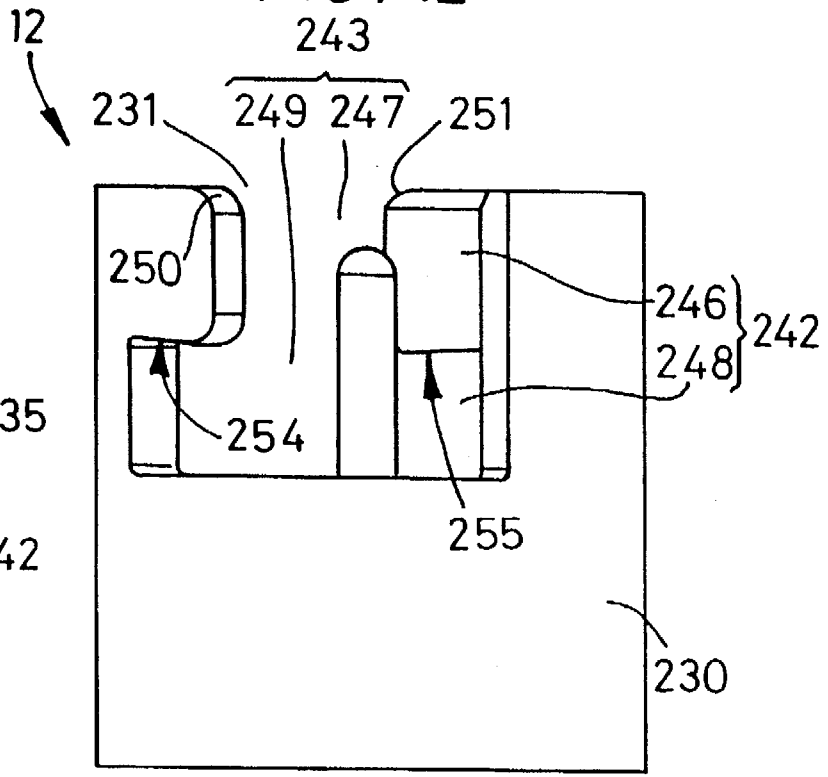
FIG. 12 is a elevational view of the socket connector of FIG. 1.
Figure 11:
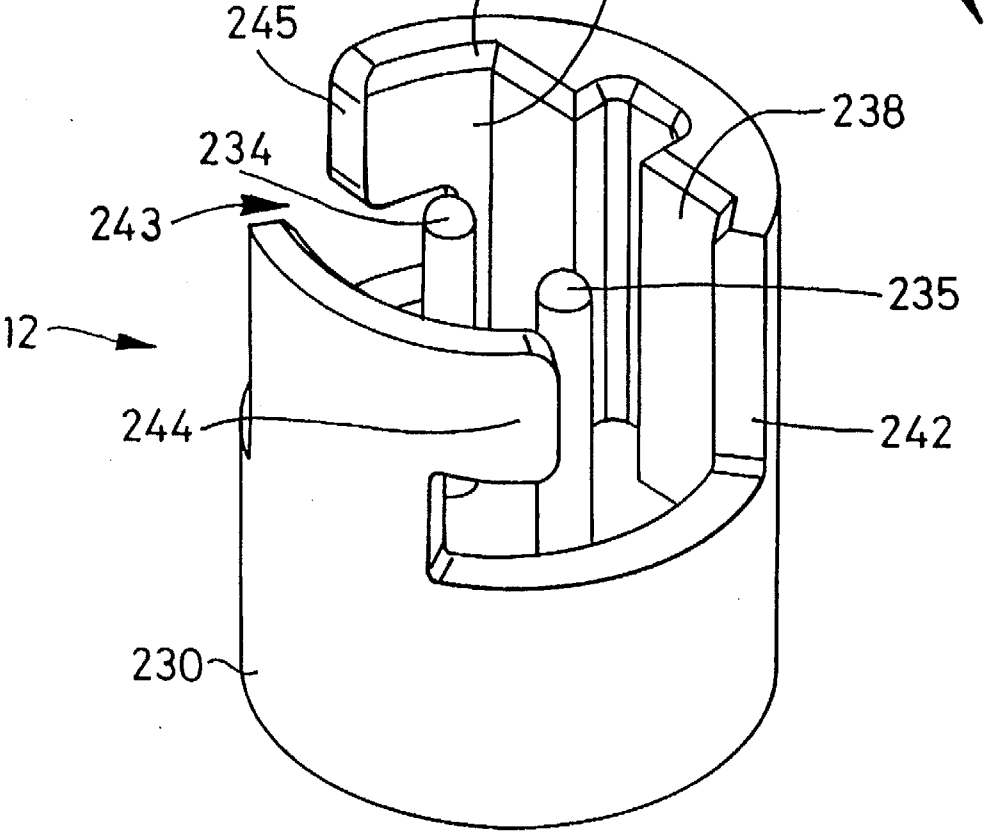
FIG. 11 is an isometric view of the socket connector of FIG. 1.

With additional reference to FIG. 12, socket connector 12 includes an insulative female connector housing 230 which supports a pair of contact pins 234, 235 designed for interconnection with contacts 210, 211 of connector 10. As also shown in FIG. 11, housing 230 includes a pair of flag-shaped apertures 242, 243 which provide locking interconnection with the prongs 160, 161 of latch 18 when plug connector 10 is fully mated to socket connector 12.

As plug connector 10 is pushed into socket connector 12, physical contact between the prongs of latch 18 and tabs 244, 245 extending into the flag-shaped apertures 242, 243 of socket connector 12 cause the prongs 160, 161 of latch 18 to rotate in the direction of arrow A against the urging of cantilever arms 176, 177. Once hooks 170, 171 of prongs 160, 161 have cleared tabs 244, 245 of socket connector 12, cantilever arms 176, 177 are free to decompress and rotate latch 18 in the direction of arrow B. Decompression of the cantilever arms 176, 177 thereby pushes hooks 170, 171 of prongs 160, 161 underneath the hook members of socket connector 12 to provide positive latching interconnection between plug connector 10 and socket connector 12.

Disconnection of plug connector 10 from socket connector 12 requires that a tool, such as a screwdriver, be inserted into latch slot 24 and rotated in the direction of arrow A against the urging of cantilever arms 176, 177. Once hooks 170, 171 of prongs 160, 161 have been rotated clear of tabs 244, 245, plug connector 10 may be withdrawn from socket connector 12. Connection of the connector assembly therefore only requires plug connector 10 to be pushed into socket connector 12 in a single insertion direction. Disconnection of the connector assembly, however, requires, first, a tool to rotate latch 18 out of engagement with tabs 244, 245 of socket connector 12, and second, the withdrawal of plug connector 10 from socket connector 12 in a direction opposite to the insertion direction.

Description of the Components of the Connector Assembly

Having provided a general overview of connector assembly 1 of the present invention, a more detailed description of the components of the preferred embodiment of the present invention follows.

Figure 2:
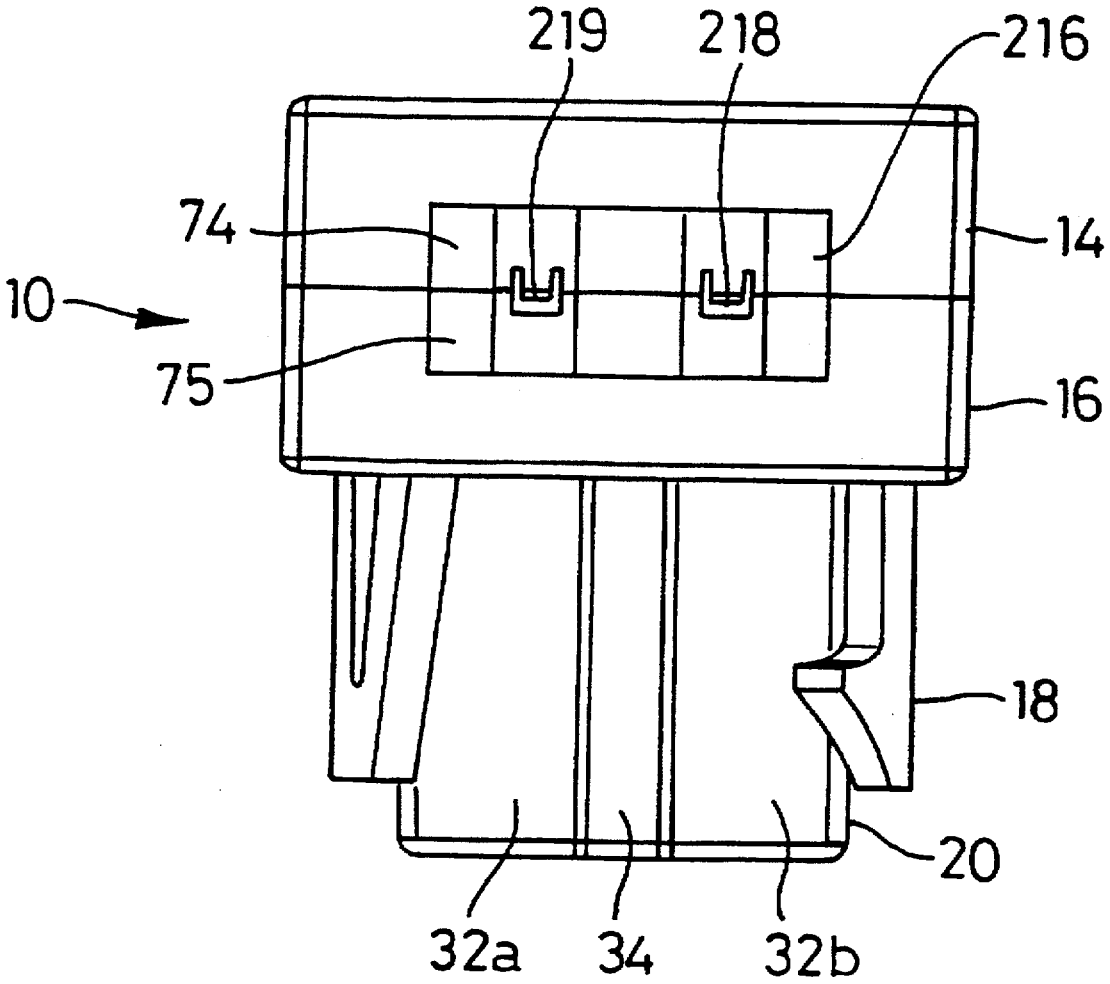
FIG. 2 shows a rear view of the plug connector of FIG. 1A.

FIG. 2 shows a rear view of plug connector 10. The interface between cover 14 and base 16 is seen to define a termination aperture 26 which provides access to termination end 218, 219 of contacts 210, 211. Behind termination ends 218, 219 is upper ferrite 74 and lower ferrite 75. Upper ferrite 74 and lower ferrite 75 provide a shielding function for plug connector 10 so as to prevent false signal generation associated with electromagnetic fields. FIG. 2 also shows the longitudinal ridge 34 which provides a keying function with socket connector 12 to prevent malassembly of the connector assembly.

Figure 3:
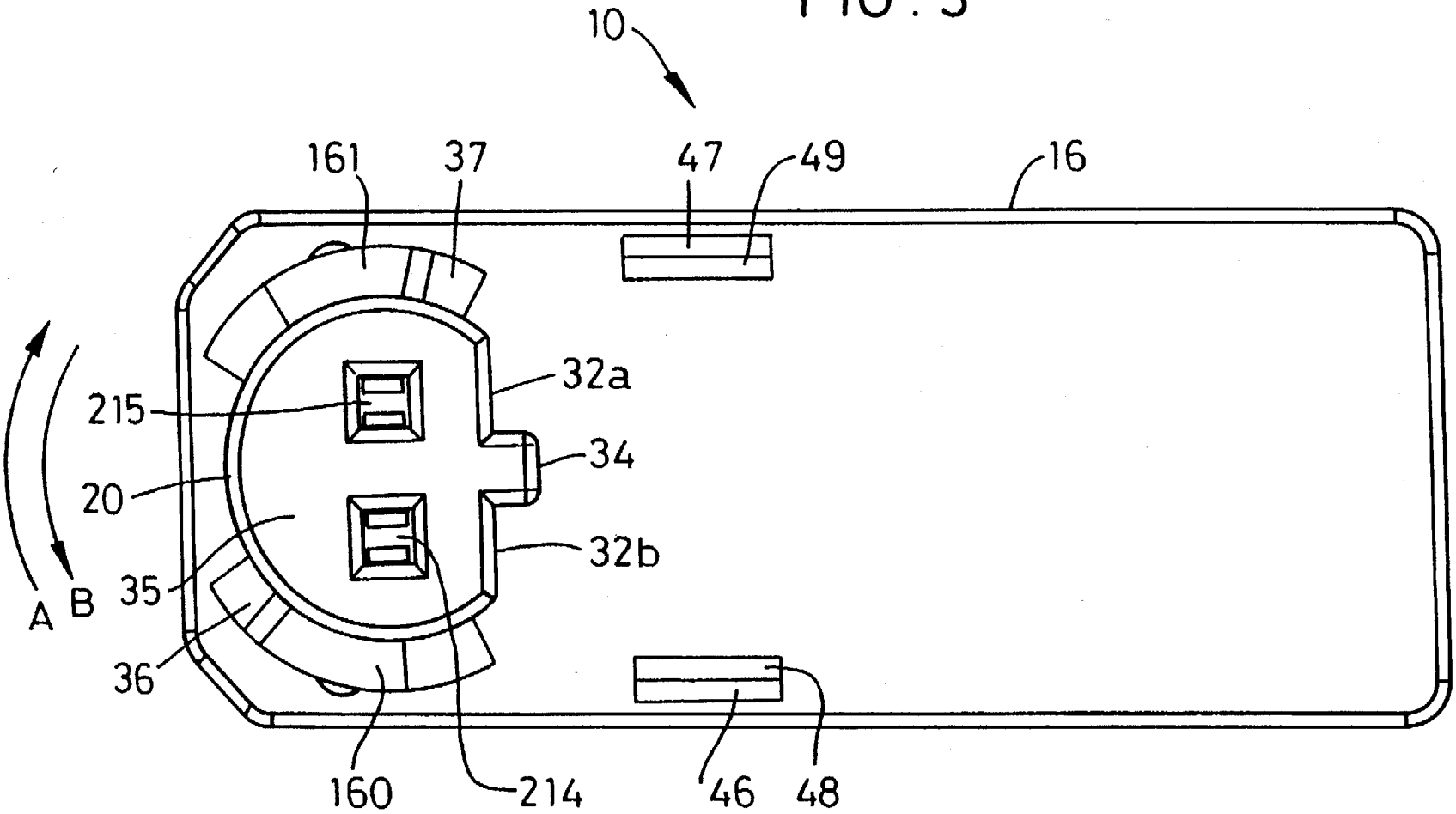
FIG. 3 shows the underside of the plug connector of FIG. 1A, showing the relationship between the plug connector shaft, the plug connector contacts, the keying feature of the plug connector shaft, and the circumferential apertures for the latch prongs.

FIG. 3 is a bottom view of plug connector 10 and more clearly illustrates keying surfaces 32*a*, 32*b*, and longitudinal ridge 34 of housing shaft 20. The keying function is contemplated to be provided by any of the methods known in the electrical connector art for ensuring assembly of two components in a single orientation. Housing shaft 20 defines shaft expanse 35 in which first socket 214 and second socket 215 are supported by base 16. Disposed along the exterior surface of shaft 20 can be seen first prong aperture 36 and second prong aperture 37 through which the prongs 160, 161 of latch 18 extend from base 16. Also visible in FIG. 3 is first lower ferrite clip 46 and second lower ferrite clip 47 which are disposed within the interior of plug connector 10 and which are accessible through first lower clip aperture 48 and second lower clip aperture 49, respectively. As will be seen later, lower ferrite clips 46 and 47 engage and hold lower ferrite 75 in the base 16.

Figure 4:
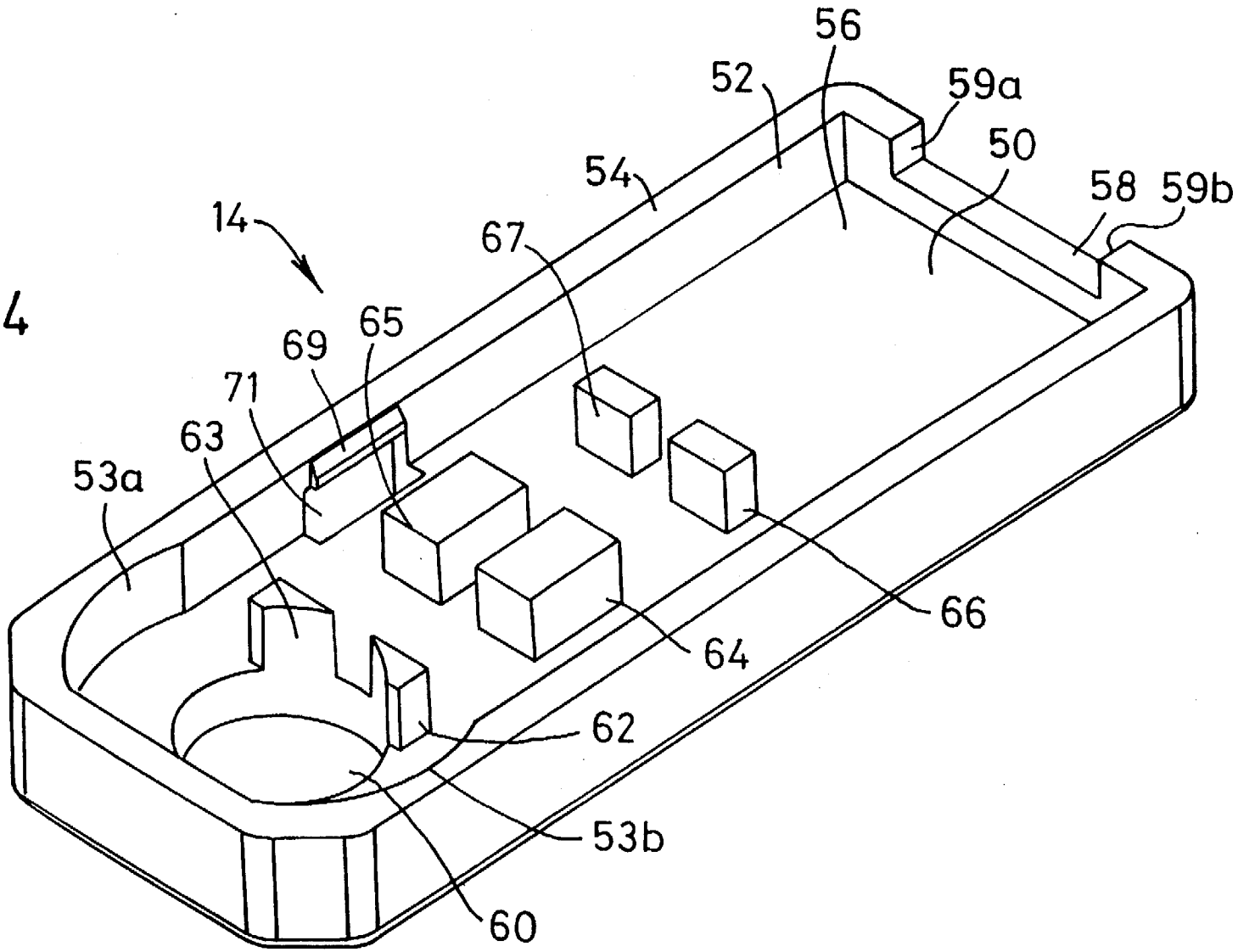
FIG. 4 is an isometric view of the interior expanse of the cover.

FIG. 4 shows an internal view of cover 14. Cover 14 includes a cover floor 50 which is parametrically bounded by cover wall 52. Cover wall 52 includes first and second bowed surfaces 53*a* and 53*b* for accommodating latch 18 when plug connector 10 is assembled. Cover wall 52 terminates in cover rim 54. Cover wall 52 defines cover expanse 56 or the interior volume of cover 14. Cover 14 partially defines termination aperture 26 due to the provision of recessed rim 58 spanning between upper aperture extents 59*a* and 59*b*. The opposite end of cover 14 includes latch keyhole 60 which accommodates latch summit 22 as is shown in FIGS. 1A and 1B. Latch keyhole 60 is positioned to be concentric with the arcs of rotation through which prongs 160, 161 of latch 18 deflect.

Cover expanse 56 includes successive pairs of downstands projecting from cover floor 50. As viewed from the position of the latch at keyhole 60, these downstands are seen to be first and second proximal downstand, 62, 63, first and second medial downstand, 64, 65, and first and second distal downstand, 66, 67 respectively. FIG. 4 also shows second upper ferrite clip 69 which projects over second upper ferrite clip aperture 71 defined by wall 52 and floor 50. First upper ferrite clip 68 and first upper ferrite clip aperture 70 are hidden from view in FIG. 4 and are located transversely across cover expanse 56 on cover wall 52.

Figure 5:
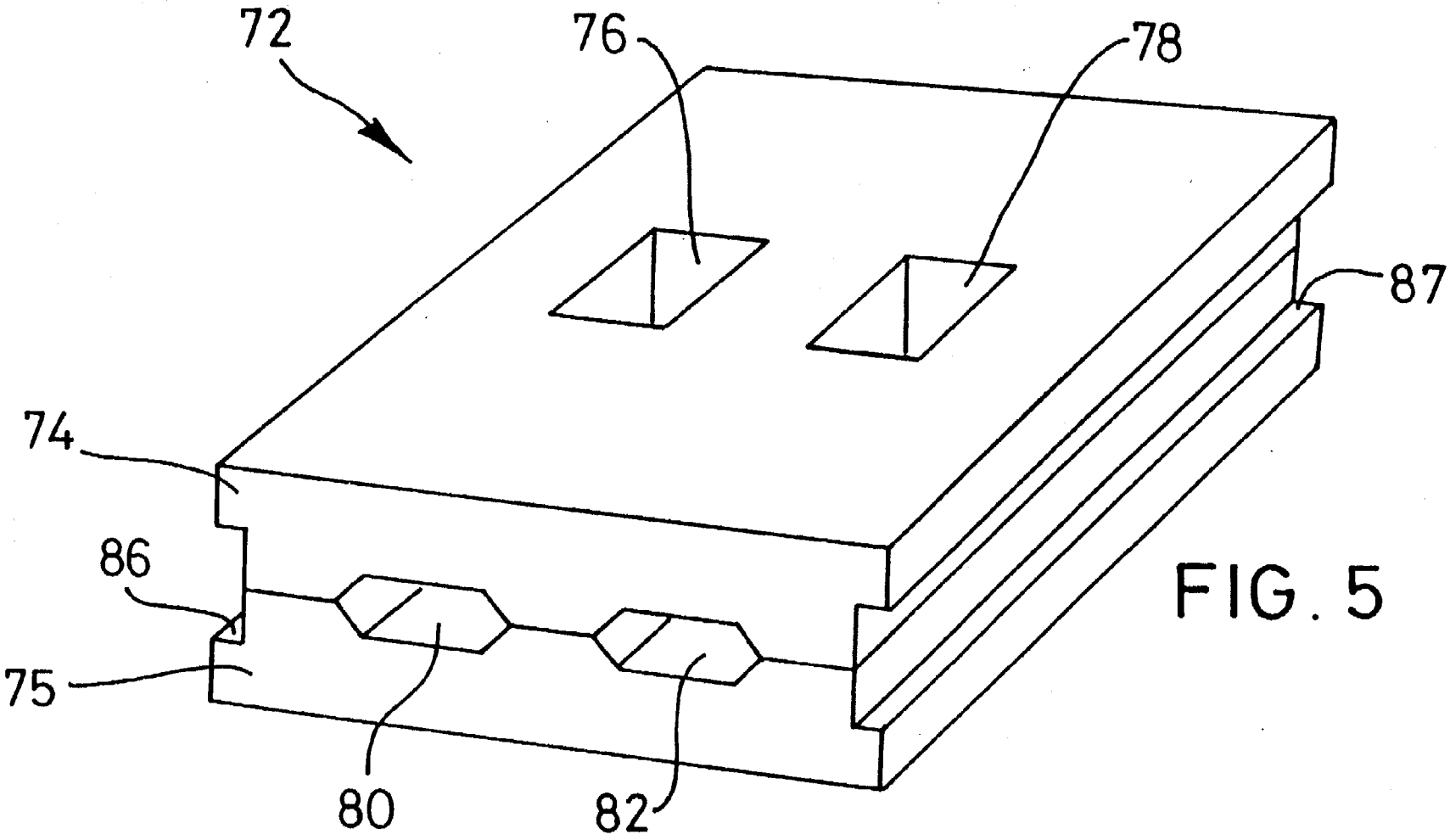
FIG. 5 is an isometric view of the ferrite assembly of the plug connector of the present invention.

FIG. 5 shows ferrite assembly 72 which comprises upper ferrite 74 and lower ferrite 75 positioned in registry with each other. Ferrite assembly 72 includes first medial passage 76 and second medial passage 78 extending therethrough. Passages 76 and 78 correspond to the dimensions of first and second medial downstands 64 and 65. Ferrite assembly 72 also includes first lead channel 80 and second lead channel 82 extending longitudinally therethrough. Preferably, longitudinal indentations are formed in upper ferrite 74 and lower ferrite 75 and are placed in registry so as to form channels 80 and 82.

Figure 6:
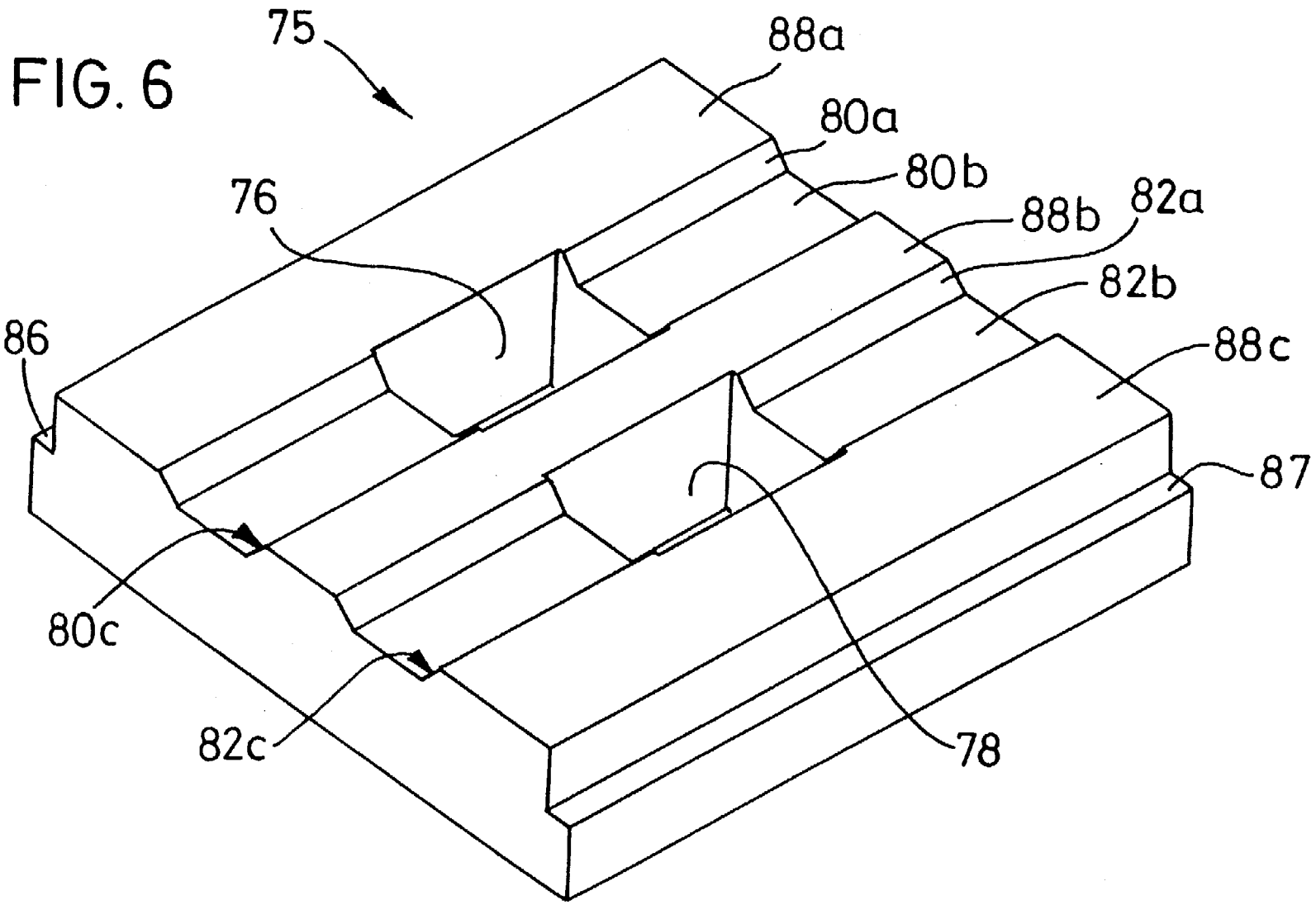
FIG. 6 shows one of the symmetrical halves of the ferrite assembly of FIG. 5.

FIG. 6 shows lower ferrite 75. In the preferred embodiment, upper ferrite 74 and lower ferrite 75 are formed to be interchangeable and thereby facilitating the assembly of connector 10. As seen in FIG. 6, lower ferrite 75 is simply characterized as a ferrite block having a pair of longitudinal grooves formed therein and a pair of through holes formed perpendicularly through the grooves. Each ferrite 74 and 75 is preferably formed to be symmetrical about a longitudinal and lateral axis so as to minimize the likelihood of improper assembly of connector 10. Each ferrite would therefore include apertures 76 and 78 for accommodating the first and second medial downstands of cover 14 or the corresponding first and second medial upstands of base 16, shown in FIG. 7. Ferrite interface surfaces 88*a*, 88*b*, and 88*c* are coplanar and engage counterpart surfaces on upper ferrite 74. Lead channels 80 and 82 are partially defined by recessed surfaces 80*a–c* and 82*a–c*, respectively. Furthermore, ferrite 75 includes transversely spaced lower clip engagement surfaces 86 and 87 which are engaged by lower clips 46 and 47 respectively to hold lower ferrite 75 within the base 16. Surfaces 86 and 87 are equally capable of being retained by first and second upper ferrite clips 68, 69 of cover 14.

Figure 7:
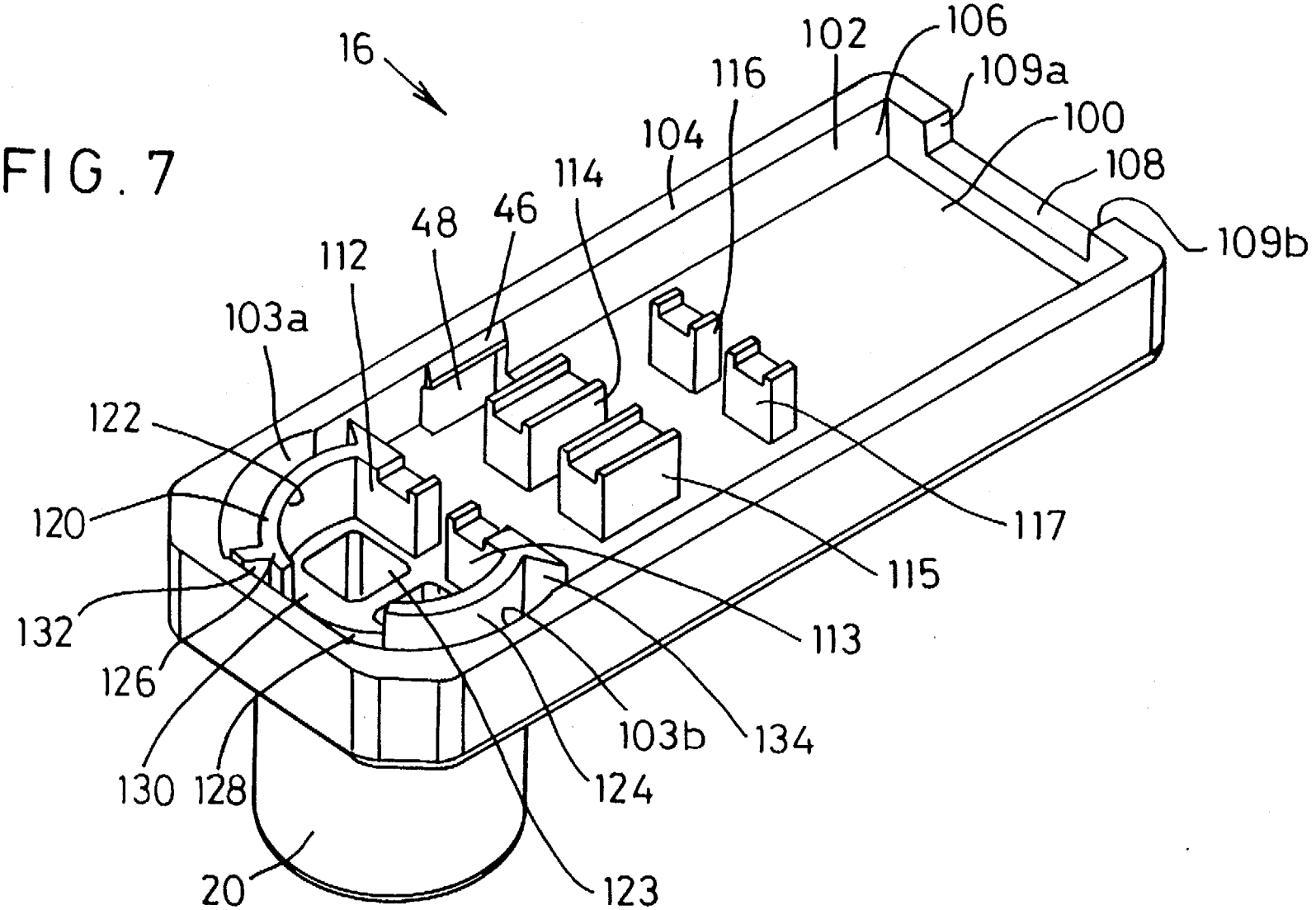
FIG. 7 is an isometric view showing the interior expanse of the base of the plug connector of FIG. 1A.
Figure 8:
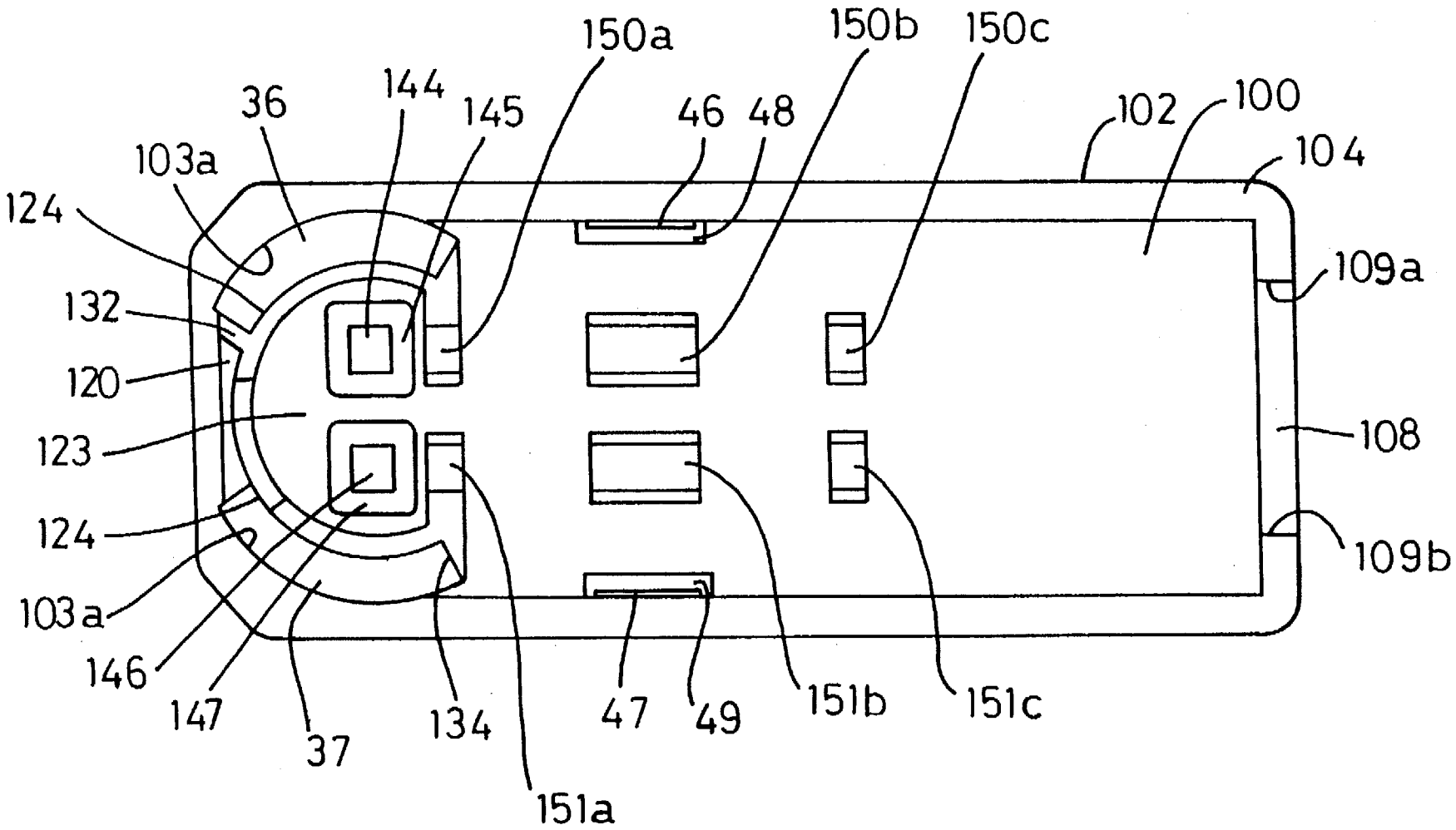
FIG. 8 is a top plan view of the interior expanse of the base of FIG. 7.

FIGS. 7 and 8 depict the base 16 of the present invention. Base 16 includes base floor 100 which is parametrically bounded by base wall 102. Base wall 102 includes first and second bowed surfaces 103*a* and 103*b* for accommodating the arcuate movement of latch 18 thereadjacent. Base wall 102 terminates in base rim 104 to thereby define base expanse 106. As is seen, base wall 102 also includes recessed rim 108 spanning between lower aperture extents 109*a* and 109*b* to form the lower portion of termination aperture 26. FIGS. 7 and 8 show another view of first and second lower ferrite clips 46 and 47 and the first and second ferrite clip apertures 48 and 49 located along base wall 102.

Towards the opposing longitudinal end of base 16, base floor 100 defines first prong aperture 36 and second prong aperture 37. First prong aperture 36 is defined adjacent to first bowed surface 103*a* of base wall 102 and convex rail surface 124. Latch rail 120 projects upward from base floor 100 adjacent prong apertures 36, 37. Latch rail 120 includes concave rail surface 122 and a convex rail surface 124 extending between first proximal upstand 112 and second proximal upstand 113. Similarly, the second prong aperture 37 is defined between the second bowed surface 103*b* and convex rail surface 124. Latch rail 120 terminates at a rail rim surface 126 which supports latch 18 thereon. Rail 120 also defines rail notch 130 adjacent recessed rail rim 128.

The first cantilevered spring stop 132 and the second cantilevered spring stop 134 project radially outward from latch rail 120 adjacent latch apertures 36, 37, respectively. Concave rail surface 122 defines contact expanse 123 and communicates with first socket aperture 144 and second socket aperture 146 defined by base floor 100.

From the perspective of contact expanse 123 can seen successive pairs of upstands projecting from base floor 100 and include first and second proximal upstands 112 and 113, first and second medial upstands 114 and 115, and first and second distal upstands 116 and 117, respectively. The uppermost surfaces of first proximal medial and distal upstands 112, 114 and 116 define aligned coplanar first contact strut support 150*a*, 150*b* and 150*c*, respectively. Similarly, the upper extents of the second proximal medial and distal upstands 113, 115 and 117 define an aligned coplanar second contact strut support 151*a*, 151*b* and 151*c*, respectively. The strut supports 150*a–c* are longitudinally aligned between first socket aperture 144 and termination aperture 26 of the assembled plug connector 10. Likewise, the second contract strut supports 151*a–c* are positioned between the second socket aperture 146 and termination aperture 26 of the assembled connector 10. Socket aperture 144 is also defined by socket rim 145. Socket aperture 146 is likewise partially defined by socket rim 147. FIG. 8 more clearly shows the projection of first and second lower ferrite clips 46, 47 into base expanse 106 and the relation to first and second clip apertures 48, 49 respectively, defined by base floor 100 and base wall 102.

Figure 9:
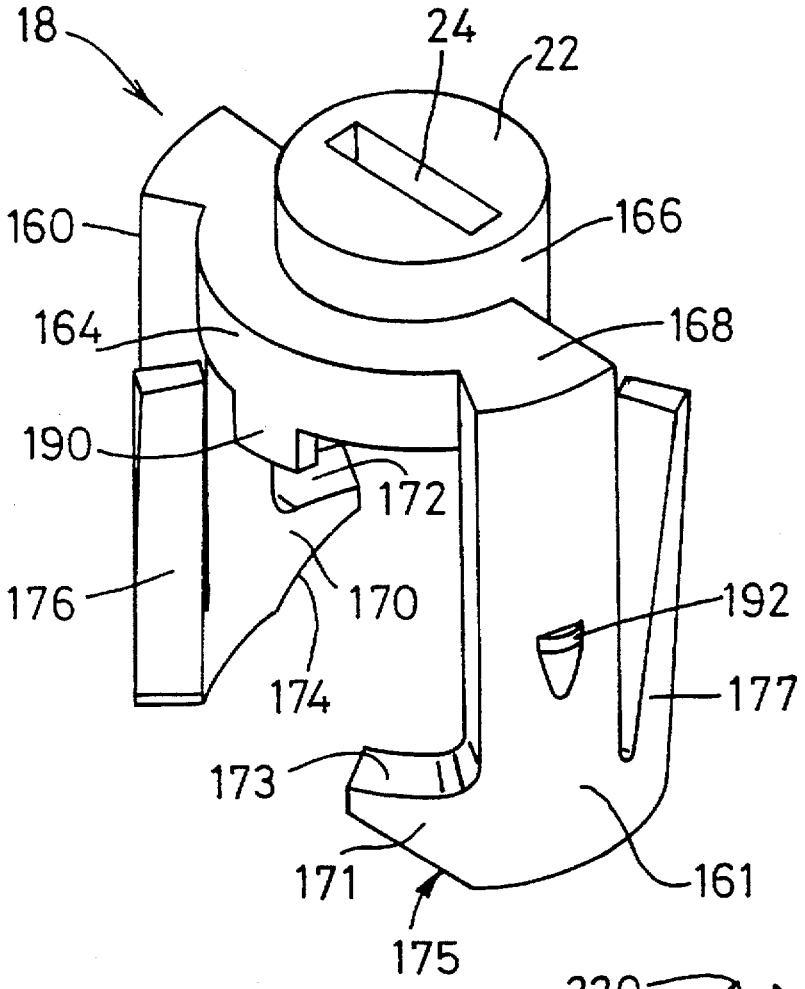
FIG. 9 is an isometric view of the latch of the plug connector of FIG. 1A.

FIG. 9 shows latch 18 of the present invention. In its preferred embodiment, latch 18 includes first and second latch prongs 160 and 161 positioned at opposing ends of latch brim 164. Latch brim 164 is seen to extend proximately halfway around the cylindrical outer surface of latch drum 166. Latch prongs 160, 161 are positioned in flush end relationship with the opposing ends of latch brim 164. Latch prongs 160, 161 are also positioned in flush edge relationship with latch brim 164 to define latch shoulder 168. Latch drum 166 is formed to have a diameter to allow it to extend through keyhole aperture 60 of cover 14 to thereby making latch slot 24 accessible through cover 14.

Latch tooth 190 depends from latch brim 164 and has an circumferential shape in conformance with brim 164. In the assembled condition, latch tooth 190 will be disposed in notch 130 of latch rail 120 and prevent over-rotation of latch 18. Each latch prong 160, 161 includes a latch hook 170, 171 rotationally aligned to one side of each prong and a cantilever spring arm 176, 177 rotationally aligned in opposition to latch hook 170, 171. Each hook 170, 171 includes a respective hookface 172, 173 and an opposed tapering undersurface 174, 175. Each latch cantilevered spring arm 176, 177 extends substantially along the length of their respective latch prongs 160,162 to form an elongate groove between each spring arm and its prong. Each spring arm terminates at a free end which is able to deflect towards its respective latch prong.

Figure 10:
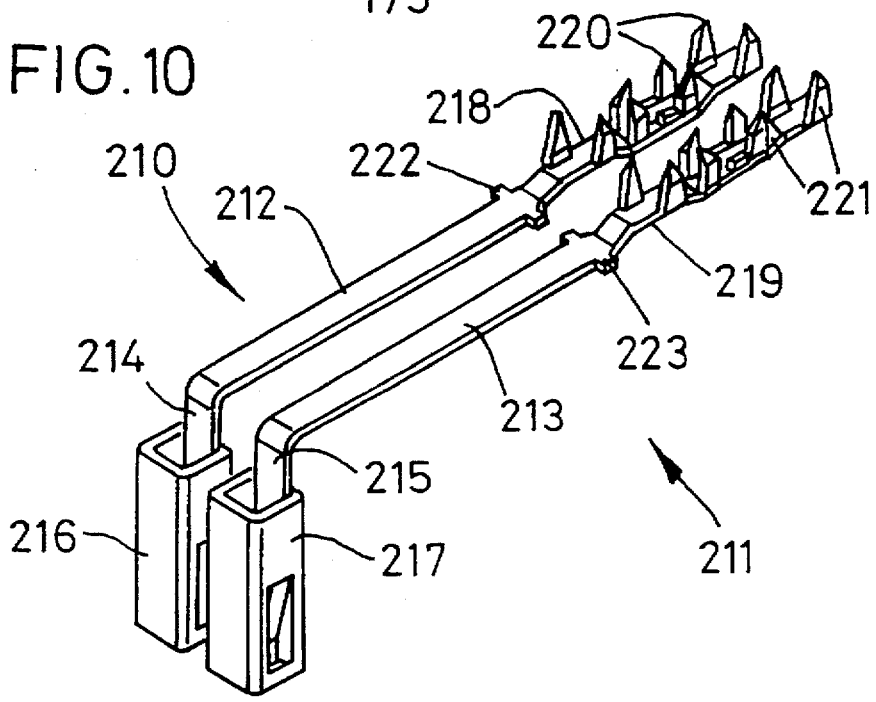
FIG. 10 is an isometric view of the contacts supported within the housing of the present invention.
Figure 14:
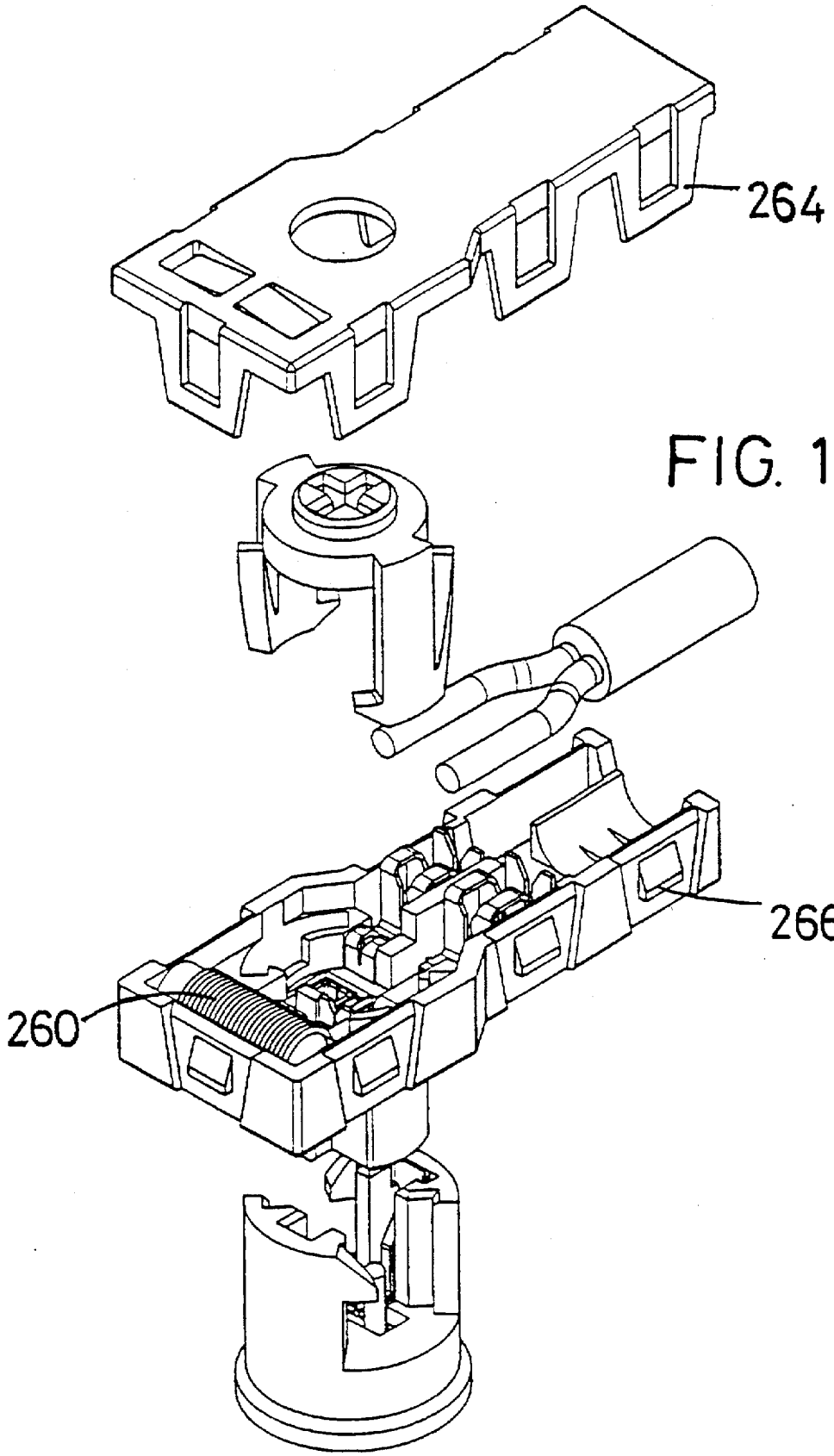
FIG. 14 shows a partially exploded view of an alternate embodiment of a plug connector of the present invention.

FIG. 10 shows first contact 210 and second contact 211 to be contained within connector 10. Contact 210 and contact 211 are preferably identically proportioned so as to enhance commonality during manufacture. It can been that contacts 210 and 211 include, respectively, an elongate contact strut 212, 213 with a socket contact 214, 215 depending downward therefrom at one end and termination end 218, 219 depending from the opposing end. It is contemplated that each contact 210, 211 will include a flange 222, 223 projecting laterally outward therefrom in order to engage a surface of an upstand on which the contacts will be placed. Each socket contact 214, 215 is formed to receive the contact pins 234, 235 of socket connector 12 as is shown in FIG. 1A. Furthermore, each termination end 218, 219 includes a plurality of upwardly projecting teeth 220, 221 to enhance the ability to engage the conductors of a flat flexible cable positioned therein. The manner of termination shown in FIG. 10 is specifically employed in terminating flat flexible cable. It is also contemplated by the present invention that the particular manner of termination provided by termination end 218, 219 may be tailored to the particular type of cable to which connector 12 is to be mated. For example, a standard crimp design could be employed for connecting to conventional round stranded wire, whereas an insulation displacement termination such as is shown in FIG. 14 could also be employed for round wire.

FIGS. 11 and 12 shows socket connector 12 in detail. Generally, socket connector 12 includes a female connector housing 230 having an open end 231 and defining a cavity 232. Housing 230 supports first and second electrical contact pins 234, 235 which extend into cavity 232 and which matingly electrically engage first and second socket contacts 210, 211 supported in housing shaft 20. Female connector housing 230 includes an internal cavity wall 238 having a shape conforming to the exterior surface of housing shaft 20. Contact pins 234, 235 are in electrical contiguity with other circuit components.

Female connector housing 230 defines first and second flag-shaped apertures 242, 243 for insertably engaging and retaining first and second prongs 160, 161 of latch 18. Each flag-shaped aperture includes a tab 244, 245, respectively, protruding therein to define a first portion 246, 247 of flag-shaped aperture 242, 243 being proximal open end 231 and having a smaller circumferential expanse than a second portion 248, 249 of flag-shaped aperture 242, 243 distal from open end 231 of female connector housing 230. Tabs 244, 245 include a prong deflection element 250, 251 which engages the tapering undersurface 174, 175 of latch prong 160, 161 during insertion of housing shaft 20 into housing 230. Each tab 244, 245 also includes a hookface surface 254, 255 for opposing hookface surface 172, 173 of the prong 160, 161 once the connector housing 15 has been fully mated with female connection housing 230 and each prong has been deflected into the locked position.

Figure 13A:
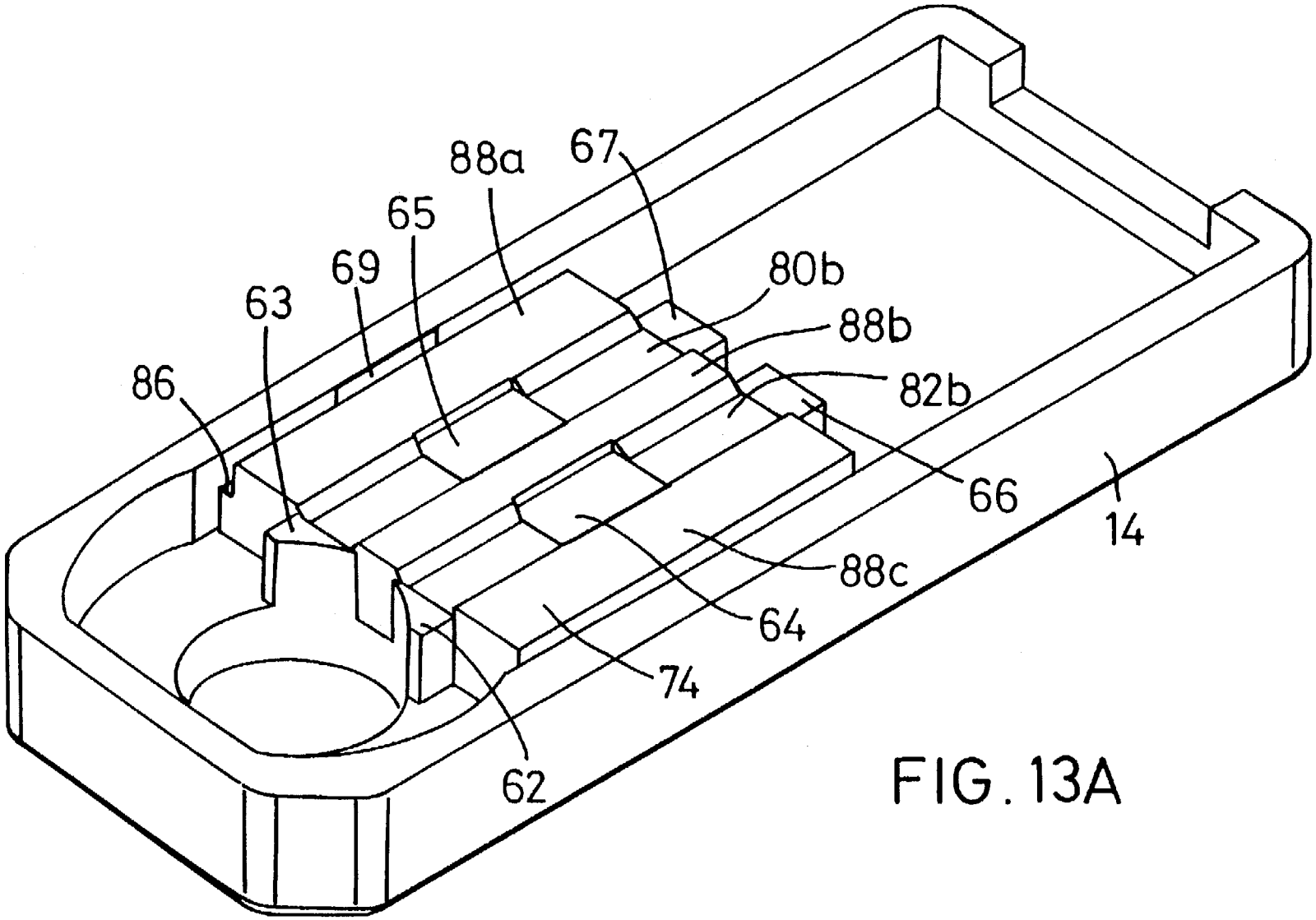
FIG. 13A shows one of the symmetrical halves of the ferrite assembly of FIG. 5 inserted in place in the interior expanse of the cover.

FIGS. 13A–F depict a sequence for assembling plug connector 10 of the present invention. In FIG. 13A upper ferrite 74 is positioned within cover 14. First and second medial downstands 64, 65 are seen projecting through apertures 76, 78 of upper ferrite 74. Note that the exposed faces of proximal downstands 62, 63, medial downstands 64, 65 and distal downstands 66, 67 extend to a height between that of interface surfaces 88*a–c* and channel surfaces 80*b* and 82*b*. Furthermore, clip 69 is shown to extend out over clip engagement surface 86. Due to the elastomeric characteristics of cover 14, upper ferrite 74 may be pushed past upper ferrite clips 68, 69 so that ferrite 74 snaps into place within cover 14. Similarly, FIG. 13B shows ferrite 75 assembled within base 16. As is seen in FIG. 13B, first strut support surfaces 150*a–c* and second strut support surfaces 151*a–c* rise above channels 80*b* and 82*b* respectively, yet both remain below the level of interface surfaces 88*a–c* of ferrite 75. However, here it is seen that each of the upstands includes longitudinal tabs 154 extending above the plane of interface surface 88*a–c*. These longitudinal tabs 154 extend only so far above interface surface 88 so as to come into contact with the respective downstands of cover 14 while still allowing interface surfaces 88*a–c* of upper ferrite 74 and lower ferrite 75 to come into engagement as well.

FIG. 13C shows each contact 210, 211 as assembled into the base 16. Each elongate strut 212, 213 rests upon its respective strut support 150*a–c*, 151*a–c* so as to be suspended above ferrite 75. When upper ferrite 74 is placed in registry above lower ferrite 75, each strut 212, 213 will likewise be suspended below upper ferrite 74 so as to prevent the possibility of short circuiting the contacts across the ferrite. Flanges 222 and 223 respectively abut against the tabs of distal upstands 116 and 117 oppositely from ferrite 72. Furthermore, socket contacts 214, 215 are disposed in their respective socket apertures 144 and 146 so as to be engagable by pins 234, 235 of socket connector 12.

Figure 13D:
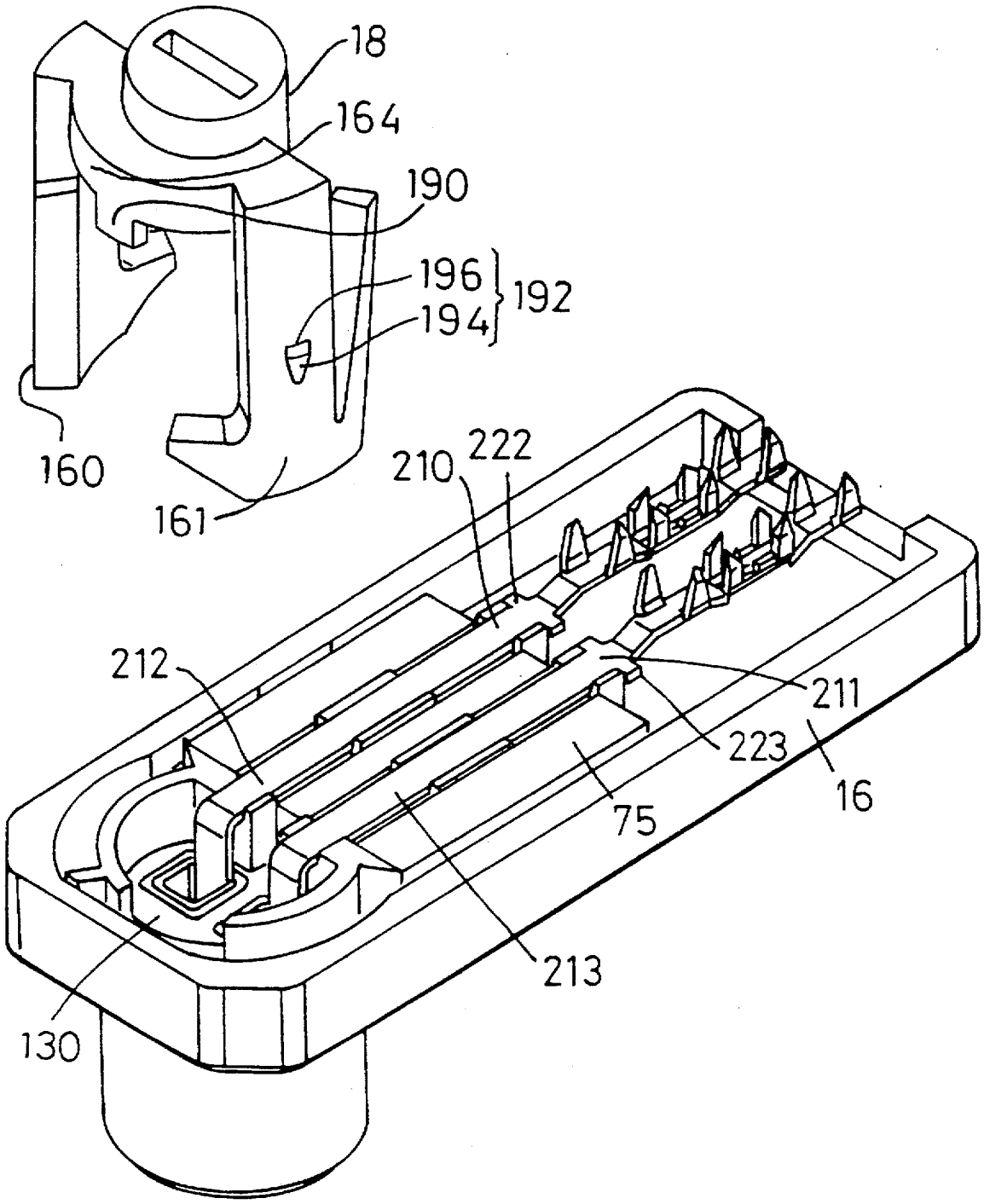
FIG. 13D shows the relative orientation of the assembly of FIG. 13C and the latch of FIG. 9 prior to inserting the latch therein.
Figure 13E:
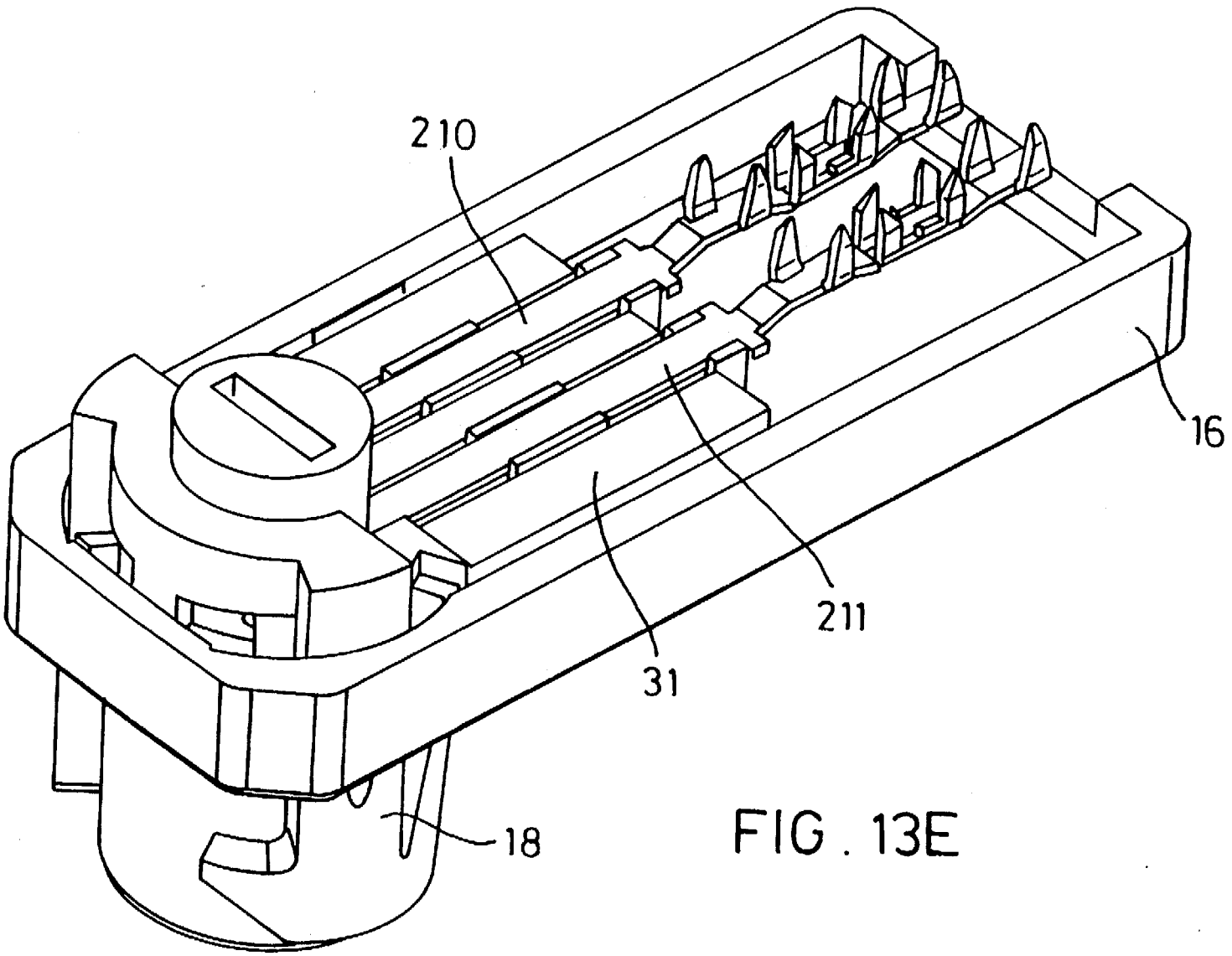
FIG. 13E shows the assembly of FIG. 13C with the latch of FIG. 9 inserted therein.

FIG. 13D shows latch 18 just prior to its insertion into base 16. Latch prongs 160 and 161 will be inserted through latch apertures 36 and 37 respectively. Each prong includes a latch detent 192 which provides a tapering surface 194 as its being inserting into base 16 and a flat abutment surface 196 which interfaces with base 16 so as to prevent the easy withdrawal of latch 18 back out from base 16. Latch 18 is positioned so that latch brim 164 sits atop rail rim surface 126 and latch tooth 190 is disposed within rail notch 130. Once latch 18 is inserted into base 16 as shown in FIG. 13E, latch 18 will have limited freedom for arcuate movement about housing shaft 20. The movement of latch 18 will be limited by a combination of the amount of travel provided tooth 190 in notch 130 and by the deflection of cantilevered spring arms 176 and 177 against spring stops 132 and 134 respectively. Cover 14, including upper ferrite 74, may then be positioned over the assembly shown in FIG. 13E as is shown in FIG. 1A.

FIG. 14 shows an alternate embodiment of the present invention where the shielding of contacts 210, 211 is provided by a wound wire coil 260. Wound wire coils are known in the art for their shielding capabilities. FIG. 14 also illustrates one possible means for attaching cover 14 to base 16 by providing deflectable clips 264 which may be inserted over bulges 266 when cover 14 is placed on base 16. It is contemplated by the present invention that cover 14 may be attached or adhered to base 16 by any means known in the art for joining two components together.

Other particular embodiments are contemplated to fall within the scope of the present invention. For example, either pins or connectors may be mounted in either plug connector 10 or socket connector 12 or both so long as they provide mating electrical connection with the other component of the connector assembly of the present invention. Additionally, while prongs 160, 161 have been shown to reside exterior to shaft expanse 35, it is also contemplated by the present invention that the prongs may extend through expanse 35 and engage a female connector housing 230 that is insertably connected within shaft expanse 35. Such an embodiment provides a tamper-proof connection between housing 15 and socket connector 12 as prongs 160, 161 are not accessible to be deflected for disconnection except by a tool engaging latch slot 24 through cover 14.

Operation of the Latching Mechanism

Figure 15A:
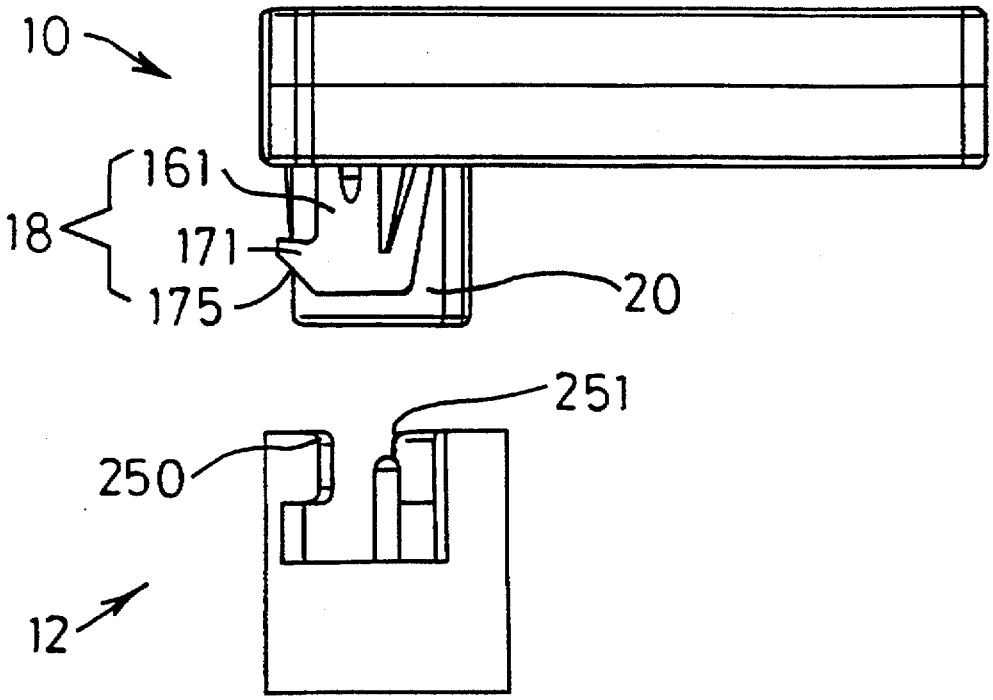
FIGS. 15A–D depict the mating of the connector assembly of FIG. 1.
Figure 15B:
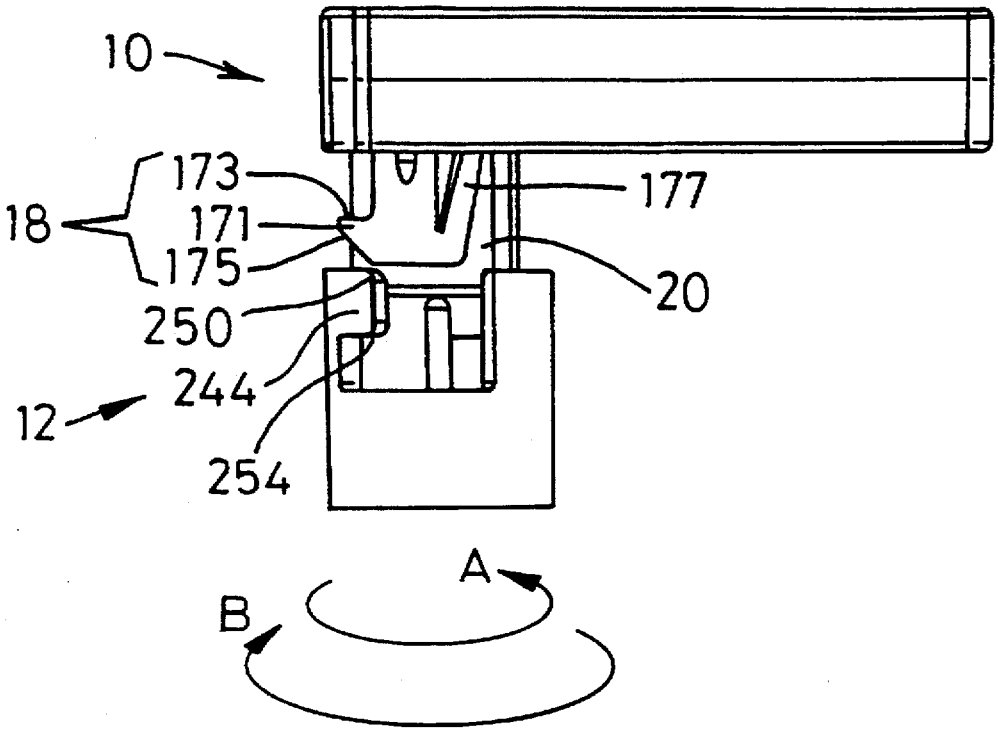
Figure 15C:
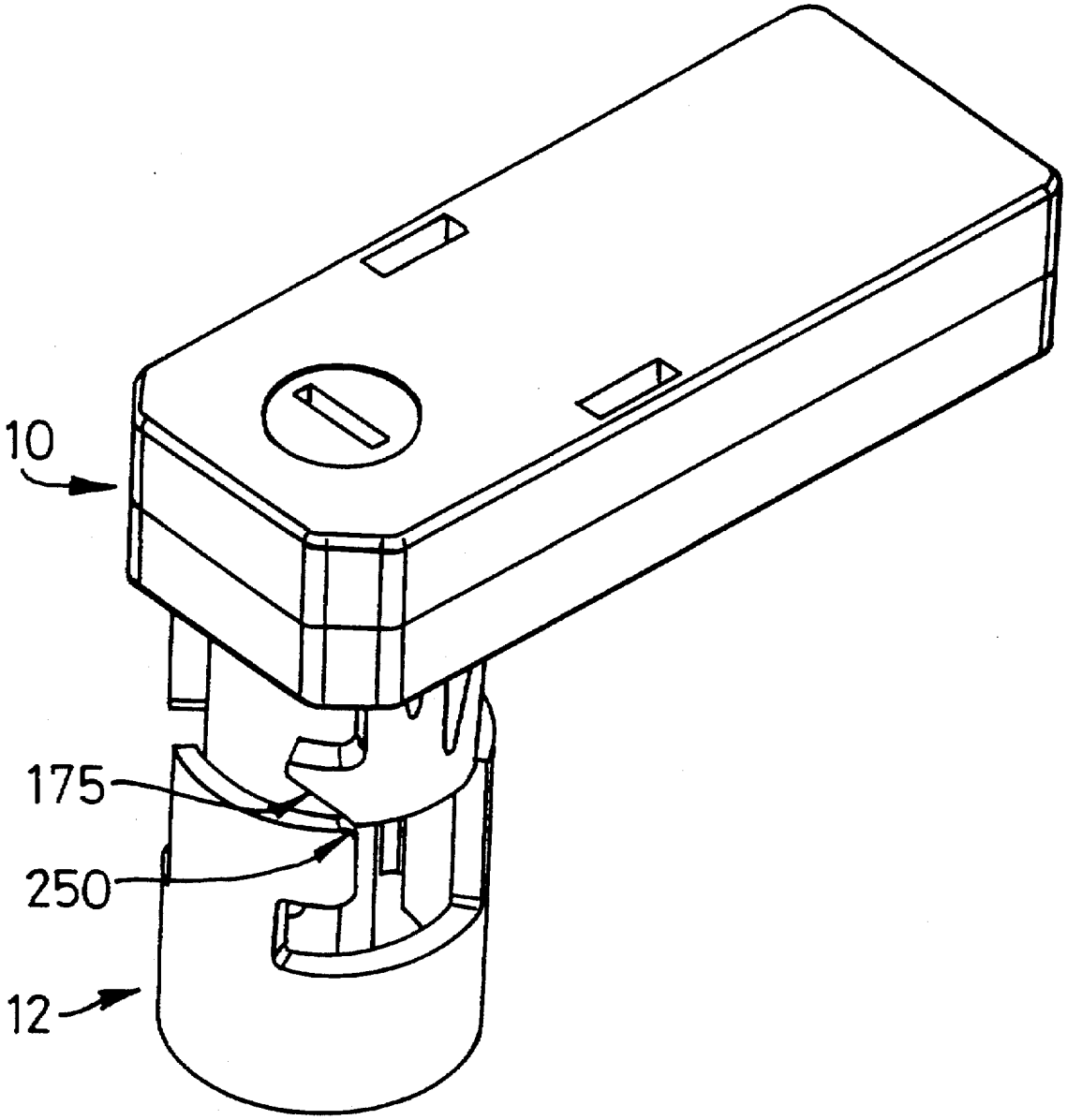
Figure 15D:
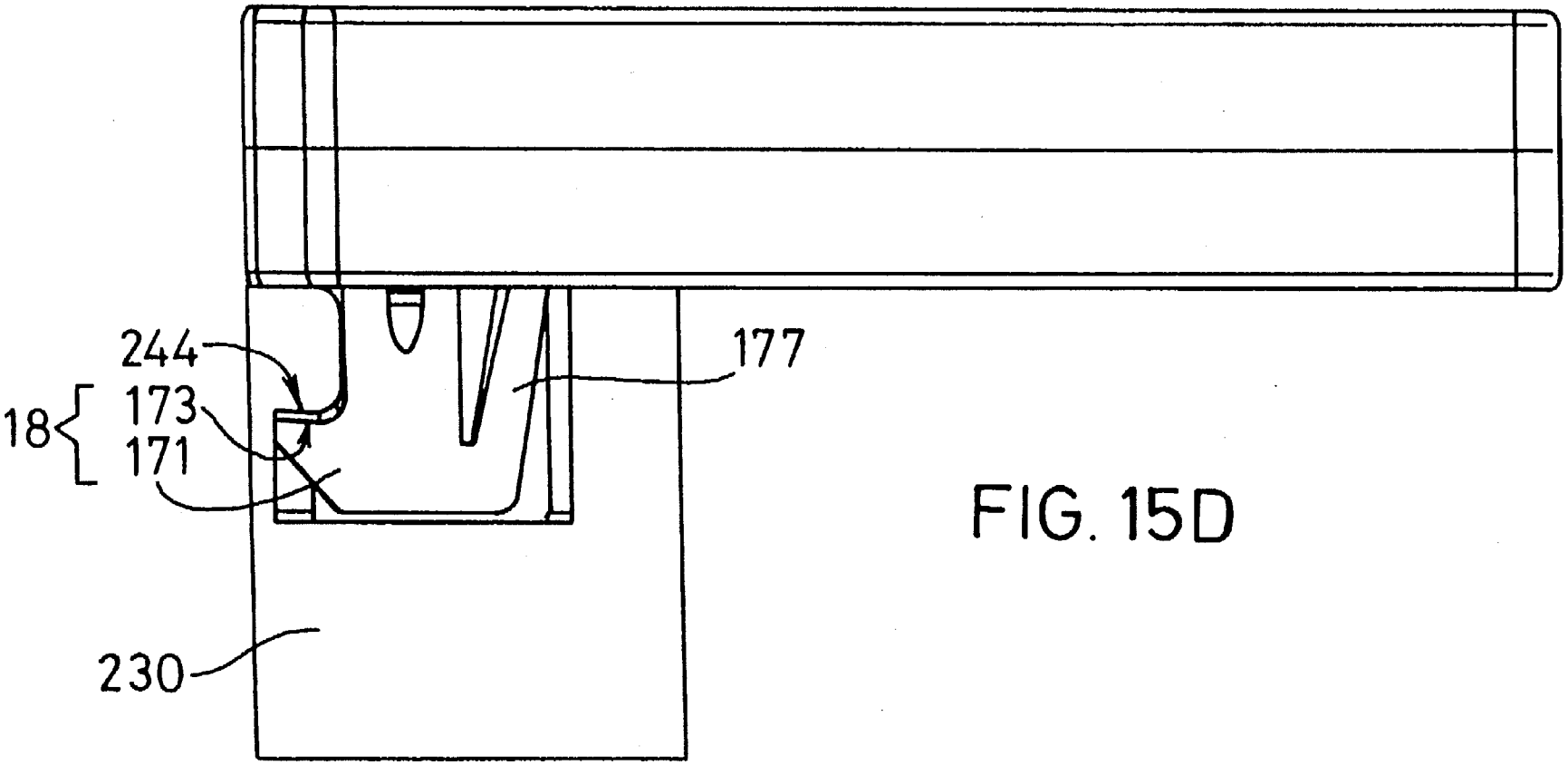
Figure 17:
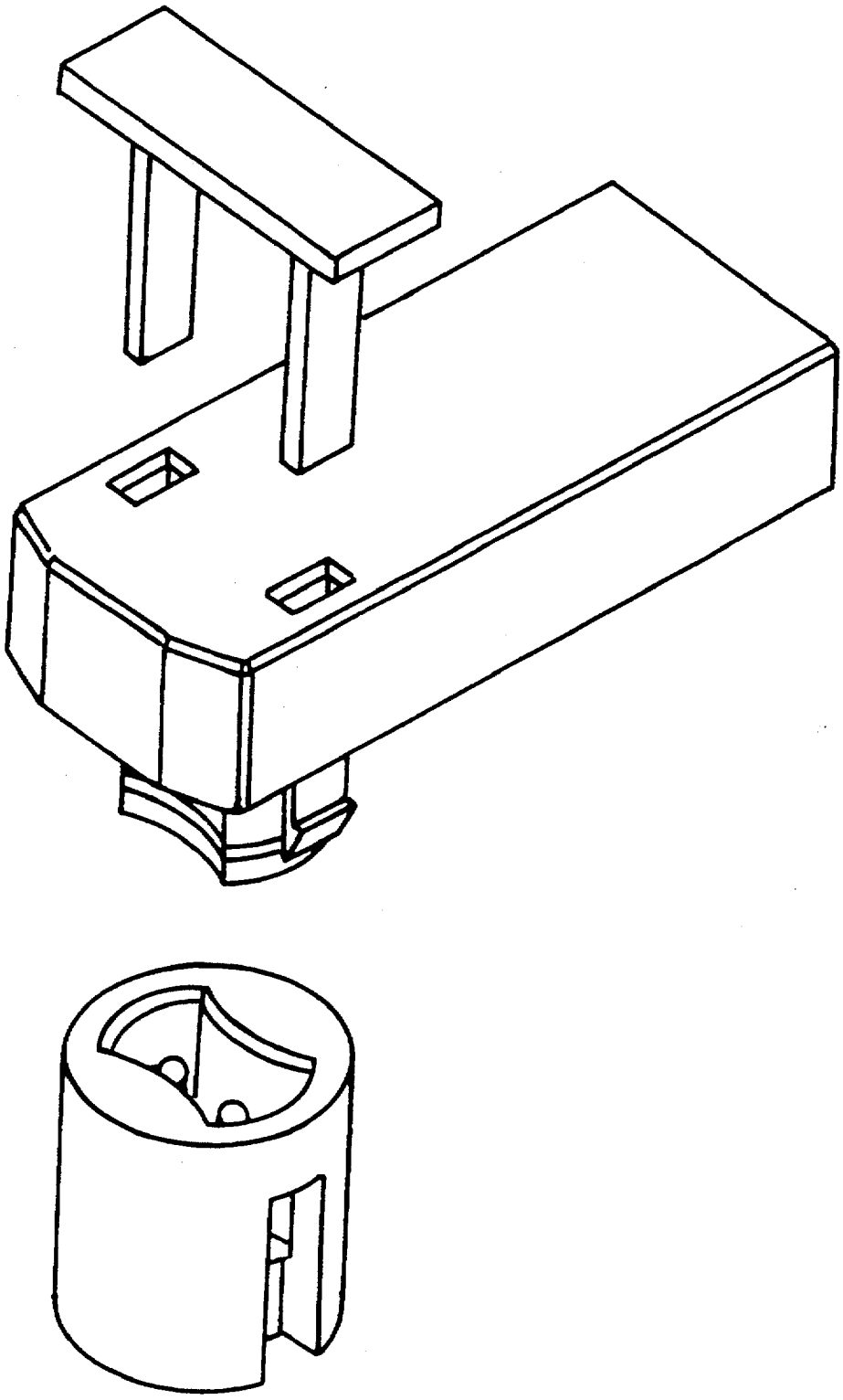
FIG. 17 shows an electrical connection assembly of the prior art employing a separate member to provide positive latching.

Having provided a detailed description of possible embodiments of the present invention, a more detailed description of the operation of connector assembly 10 follows. As plug connector 10 is brought down upon socket connector 12, as shown in FIGS. 15A–C, tapering undersurface 174, 175 of latch hook 170, 171 comes into contact with prong engagement member 250, 251 of tab 244, 245. Housing shaft 20 is keyed to engage socket connector 12 in a single mating orientation. Continued insertion of plug connector 10 into socket connector 12 results in member 250, 251 pushing on latch hook undersurface 174, 175 so as to cause latch 18 to rotate about housing shaft 20 in the latch deflection direction represented by arrow A. Rotation of latch 18 in the direction of arrow A causes the deflection of cantilever arm 176, 177 which generates a locking force opposing the latch deflection force as represented by arrow B. As shown in FIG. 15D, once latch hook 170, 171 is inserted clear of tab 244, 245, cantilever arm 176, 177 will be free to decompress causing latch 18 to move in the direction of arrow B causing hookface 172, 173 to be placed in opposition to socket connector hookface 254 which defines a connected and locked position between plug connector 10 and socket connector 12. Plug connector 10 is thereby positively retained within socket connector 12 due to the interfering engagement between the hookfaces of the latch and the socket connector.

As can be seen in FIG. 1B, latch 18 includes latch summit 22 which is accessible through cover 14. Latch summit 22 defines latch slot 24 which may be engaged by a tool such as a screwdriver, not shown, and turned in the deflection direction of arrow A so as to deflect cantilever spring arm 176, 177 until latch hook 170, 171 is clear of tab 240. Using the tool to hold the latch in its fully deflected position, the worker may grab hold of plug connector 10 and withdraw it away from socket connector 12 to achieve disconnection.

While the particular embodiment of the present invention has been shown and described, it will be obvious to those skilled in the art that changes and modifications may be made without departing from the teachings of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A connector assembly comprising:

a male connector including an elongate male connector housing and a dependent housing shaft;

an elongate first electrical contact supported in said housing having a first cable terminating end and an opposed interconnection end extending into said shaft;

a latch supported by said housing and rotatable about said shaft;

a female connector including a female connector housing having a central cavity therein for insertable connection with said housing shaft;

a second electrical contact supported in said cavity of said female connector housing for electrical engagement with said interconnection end of said first contact upon insertable engagement between said housing shaft of said male connector and said female connector housing; and a mating latch receiving element formed on said female connector housing for matingly receiving said latch of said male connector;

wherein said latch is rotatably movable into locking engagement with said latch receiving element under the bias of a spring upon insertable engagement between said shaft and said female connector housing.

2. A connector assembly of claim 1, wherein said latch is rotatably movable against the bias of said spring to disengage said latch from said latch receiving means to remove said male connector from said female connector.

3. A connector assembly of claim 1, wherein the spring bias against the latch operates against the male connector housing.

4. A connector assembly of claim 1, wherein said latch includes a pair of elongate prongs depending through said male connector housing.

5. A connector assembly of claim 4, wherein said latch receiving element comprises a pair of flag-shaped apertures, said female connector housing including a tab extending into each flag-shaped aperture, said tab being in flush end relationship with said female connector housing.

6. A connector assembly of claim 1, wherein said elongate contact is shielded within said housing to prevent unintentional signal generation by exposure of the connector assembly to an electromagnetic field.

7. A connector assembly of claim 6, wherein the shielding is provided by a ferrite assembly, wherein said elongate electrical contact is supported in spaced isolation through said ferrite assembly.

8. A connector assembly of claim 7, wherein said ferrite assembly comprises a top ferrite component and a bottom ferrite component, said top ferrite component being secured in said housing cover and said bottom ferrite component being secured in said housing base.

9. A connector assembly of claim 1, wherein said contact includes a wound wire induction coil within said male connector housing.

10. A connector assembly of claim 1, wherein said connector shaft and said female connector housing are shaped to provide keying means to prevent misassembly of said shaft to said female connector housing.

11. A connector assembly of claim 1, wherein said connector shaft is insertable into said cavity of said female connector housing.

12. A connector assembly of claim 1, wherein said latch includes engaging means accessible through said housing for rotating said latch against the bias of said spring.

13. A connector assembly of claim 5, wherein each of said prongs includes a locking surface for opposing the underside of said tab when said shaft is mated with said female connector housing.

14. A connector assembly of claim 13, wherein each of said prongs includes a tapering underside from the free end of said latch to said locking surface.

15. A connector assembly of claim 1, wherein said latch includes a latch spring.

16. A connector assembly of claim 15, wherein said latch spring is a cantilever spring tapering from the free end of one of said prongs toward said male connector housing.

17. A connector assembly of claim 16, wherein the free end of said cantilever spring engages said male connector housing.

18. A connector assembly for an automobile airbag gas generator assembly for positively retentatively mating a male connector to a female connector, said assembly comprising:

a male connector body, said male connector body, including a substantially elongate portion having a first end, a second end, an interior passageway extending through said male connector body, said body having;

an elongate hollow connector shaft depending from said male connector body and terminating at a shaft rim, said shaft rim defining an open end communicating with the interior of said shaft, said interior of said shaft communicating with said interior passageway through said body;

an electrical contact, said contact supported by said body in said interior of said shaft and extending through said interior passageway in shielded isolation, said contact terminating at a connecting terminus for electrical connection;

wherein said body supports in said interior expanse of said connector shaft one of a male pin contact and a female socket contact;

a female connector, said female connector including an elongate hollow member defining an interior expanse, said hollow member terminating at a member rim, said member rim defining an open receiving end communicating with said interior expanse, said member including a member wall cooperatively conforming to said connector shaft for insertable engagement with said connector shaft through said open receiving end;

said member wall defining a first and second longitudinal flag-shaped aperture, each of said first and second flag-shaped apertures having a first circumferential expanse proximal to said open receiving end and a second circumferential expanse distal from said open receiving end and communicating with said first circumferential expanse, said second circumferential expanse being wider than said first circumferential expanse, the portion of said member wall extending over said second circumferential expanse defining a tab;

wherein said female connector supports in said interior expanse includes the other of said male pin contact and said female contact; and a deflectable latch mounted within said interior passageway, said latch including a first and second elongate prong extending adjacent said connector shaft, said first and second prongs being deflectable by said tab of said female connector about the circumferential course of said flag-shaped aperture during mating of said male connector to said female connector, said prong being spring-biased in a direction opposite to the deflection by said tab, said prong including a hook surface which the spring positions for engaging the underside of said tab when said hook surface is inserted into said flag-aperture past said tab.

19. The connector according to claim 18, wherein said first and second prongs terminate at a free end, said free end includes a hook extending to a first direction and a spring extending to a second transverse direction opposite said first direction, said hook including a locking surface proximal said male connector body and a tapering surface from said locking surface to said free end.

20. The connector according to claim 19, wherein said spring is a cantilever spring extending acutely from said free end towards said male connector body.

* * * * *